US005323578A

United States Patent [19]

Chagnon et al.

[11] Patent Number: 5,323,578

[45] Date of Patent: Jun. 28, 1994

[54] PREFABRICATED FORMWORK

[76] Inventors: Claude Chagnon, 8, rue Daniel, Granby, Quebec, Canada, J2G 9T1; Yvan Goupil, 12, rue Daniel, St-Luc, Quebec, Canada, JOJ 2A0; Serge Chagnon, 106, Des Bouleaux, Brigham, Quebec, Canada, JOE 1J0; Alain Chagnon, 84 Germaine, St-Luc, Quebec, Canada, JOJ 2A0; Luc Chagnon, 125, Bellechasse, Dunham, Quebec, Canada, JOE 1M0; Robert Chagnon, 8, rue Daniel, Granby, Quebec, Canada, J2G 9J1; Trung T. Pham, 525, Francois Résout, Lachenaie, Quebec, Canada, J6W 5L8

[21] Appl. No.: 809,307

[22] Filed: Dec. 18, 1991

[30] Foreign Application Priority Data

Dec. 19, 1990 [CA] Canada ..... 2032640

[51] Int. Cl.[5] ..... E04B 2/00

[52] U.S. Cl. ..... 52/426; 52/309.12; 52/562; 249/40; 249/215

[58] Field of Search ..... 52/699, 562, 563, 564, 52/698, 426, 309.7, 309.12; 249/40, 213, 215, 216, 218, 309.8

[56] References Cited

U.S. PATENT DOCUMENTS

| | | | |
|---|---|---|---|
| 1,578,511 | 3/1926 | Gladwin | 52/426 |
| 2,864,150 | 6/1958 | Henderson . | |
| 3,321,884 | 5/1967 | Klaue | 52/426 |
| 3,611,664 | 10/1971 | Barbera | 52/562 X |
| 3,625,470 | 12/1971 | Shoemaker . | |
| 3,782,049 | 1/1974 | Sachs | 52/309.12 X |
| 3,964,226 | 6/1976 | Hala et al. | 52/562 |
| 4,241,555 | 12/1980 | Dickens et al. | 52/309.7 X |
| 4,604,843 | 8/1986 | Ott et al. . | |
| 4,730,422 | 3/1988 | Young | 52/562 |
| 4,765,109 | 8/1988 | Boeshart | 52/426 |
| 4,888,931 | 12/1989 | Meilleur . | |
| 4,901,494 | 2/1990 | Miller et al. | 52/426 |
| 4,969,302 | 11/1990 | Coggan et al. | 52/309.8 |
| 4,976,081 | 12/1990 | Litzenberger | 52/426 |

FOREIGN PATENT DOCUMENTS

| | | | |
|---|---|---|---|
| 1233042 | 2/1988 | Canada . | |
| 1484201 | 4/1969 | Fed. Rep. of Germany | 52/426 |
| 2538246 | 10/1976 | Fed. Rep. of Germany . | |
| 2608196 | 6/1988 | France . | |
| 614750 | 12/1979 | Switzerland . | |

*Primary Examiner*—Carl D. Friedman
*Assistant Examiner*—Kien Nguyen
*Attorney, Agent, or Firm*—Swabey Ogilvy Renault

[57] ABSTRACT

A prefabricated collapsible formwork module is assembled at a factory site, including the provision of a pair of sheathing panels which can be made of insulating material, as well as the mounting of the vapor barrier, the filler strips, bearing blocks, and flexible or collapsible connecting elements extending between the panels extending between the panels to retain the panels when they are being erected. The sheathing panels may also have a waterproof membrane applied thereto, and the concrete reinforcement is assembled between the sheathing panels at the factory site. When the formwork module is fully assembled, it is then collapsed, that is, by moving one sheathing panel against the other including collapsing the collapsible connecting elements and sandwiching the concrete reinforcement which is preferably in the form of a grid, and the formwork module can then be stored and transported to a building site. At the building site, the formwork module is spread apart to the full extent of the connecting elements and spacers are provided between the sheathing panels for maintaining the panels apart. Typical joint mating means are installed at the edge area of the sheathing panels to form joints with adjacent panels.

35 Claims, 26 Drawing Sheets

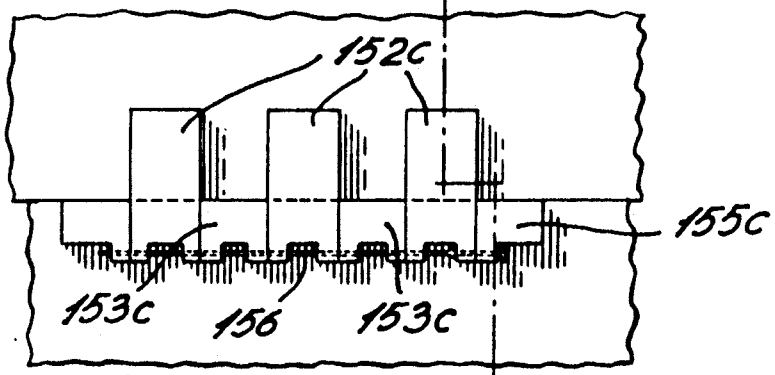
Fig. 10
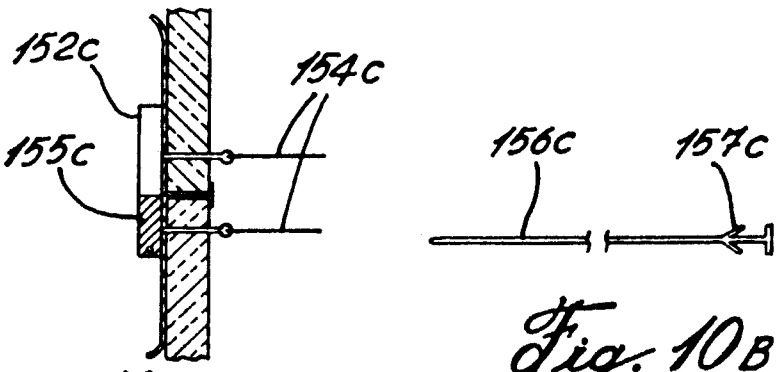
Fig. 10A
Fig. 10B
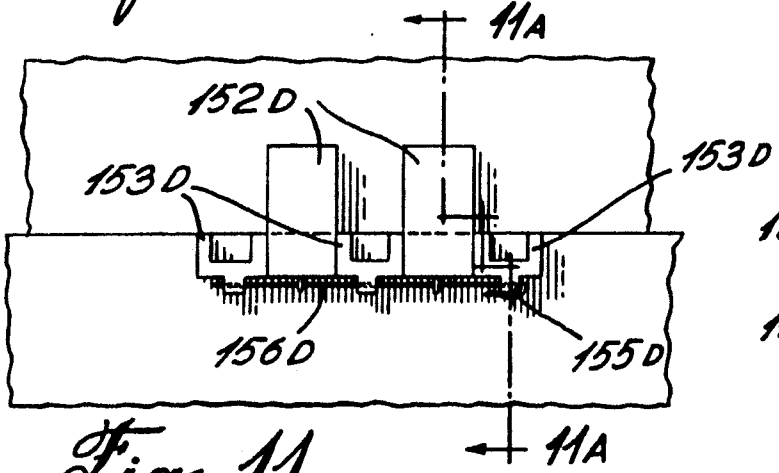
Fig. 11
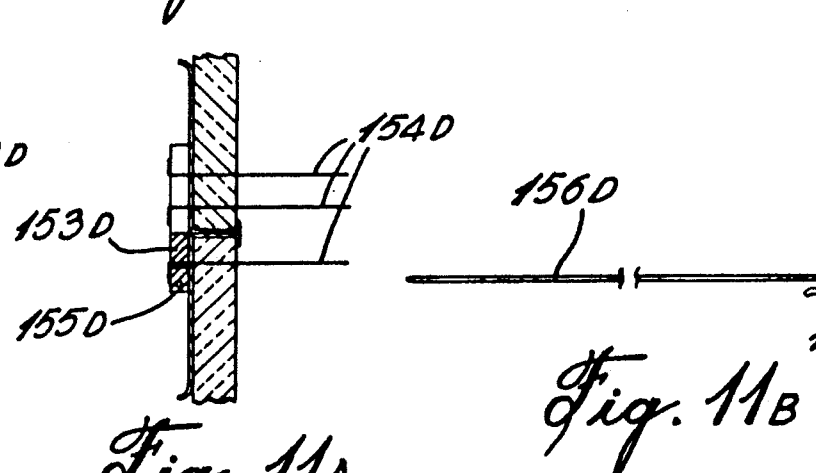
Fig. 11A
Fig. 11B

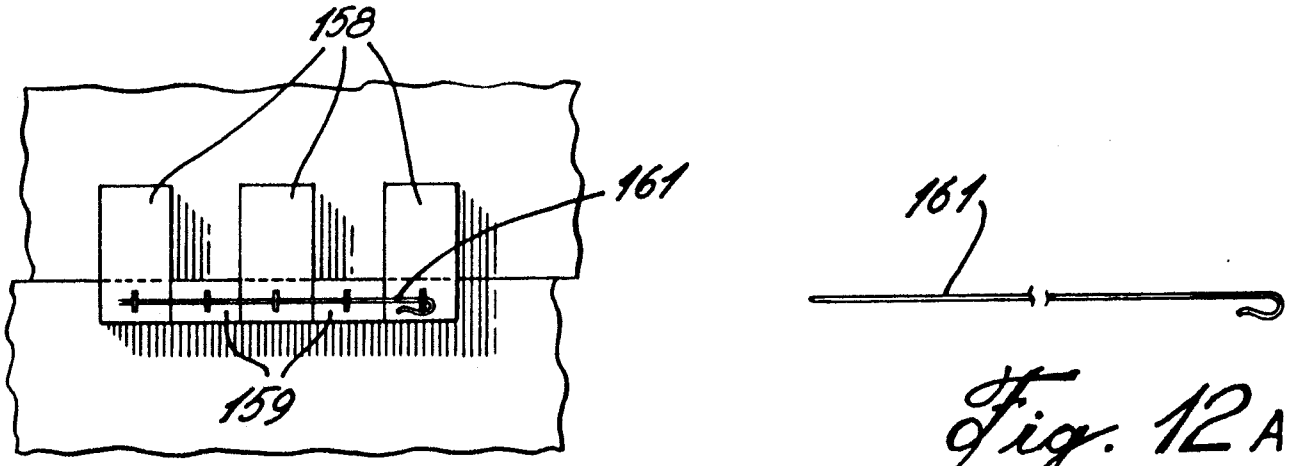
Fig. 12
Fig. 12A
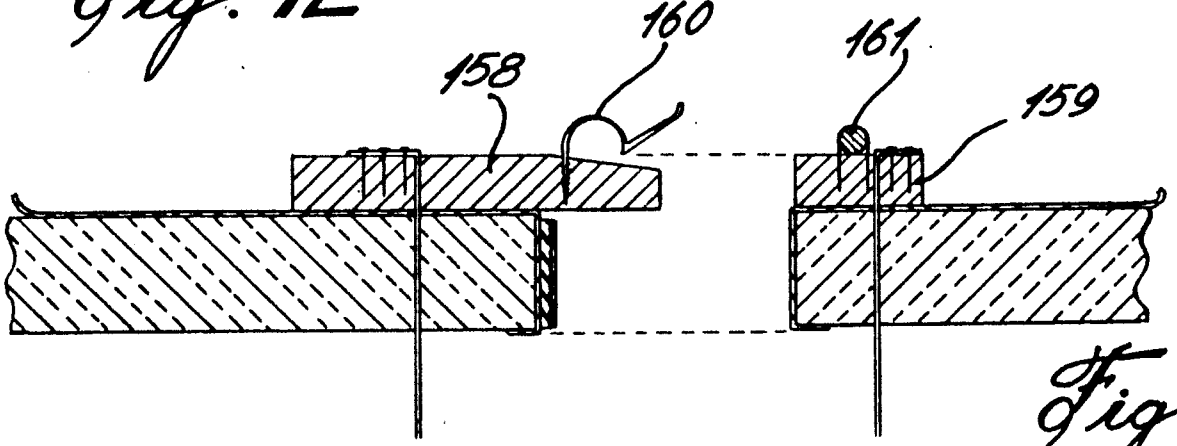
Fig. 12B

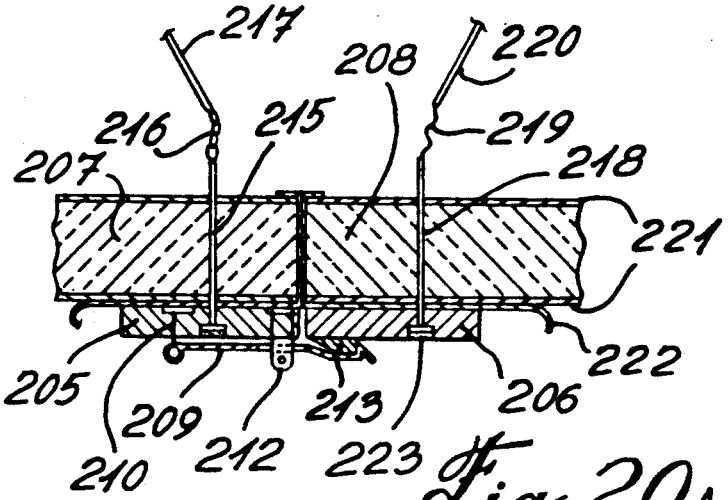
Fig. 20A
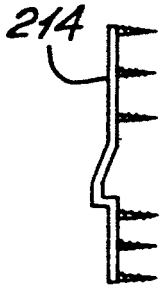
Fig. 20C
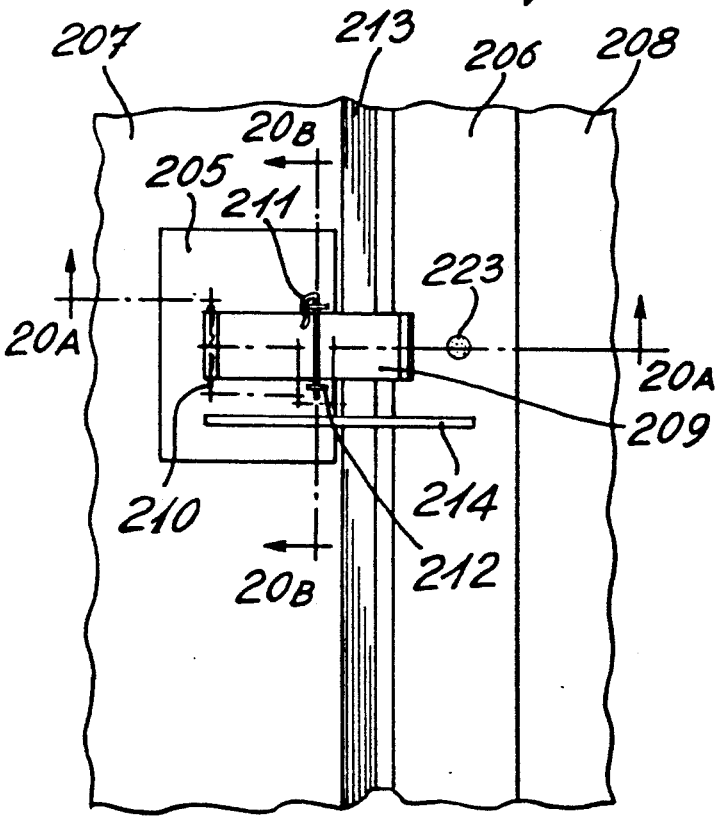
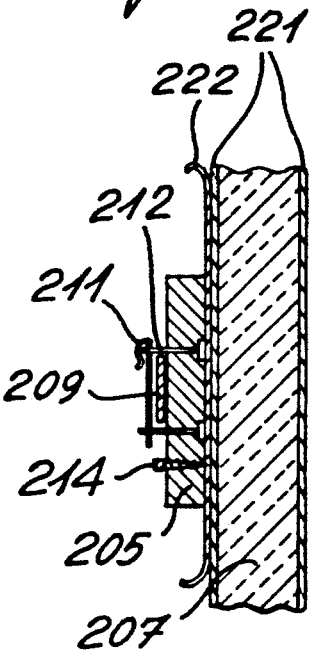
Fig. 20B
Fig. 20

PREFABRICATED FORMWORK

BACKGROUND OF THE INVENTION

1. Field of the Invention

The present invention relates to a prefabricated formwork for concrete and more particularly to a collapsible prefabricated formwork for concrete walls.

2. Description of Prior Art

The time-tested method of constructing concrete walls for buildings include the pouring of concrete into a formwork set up, in situ. This operation includes the erection of the formwork which includes a pair of vertical sheathing panels in a spaced relationship by means of connecting elements. Such formwork is either of the removable and thus reusable type or is of a lost form type wherein the formwork becomes part of the structure after the concrete is cured. A lost form of formwork utilizing sheathing panels of insulating material is called generally an insulating formwork.

All known insulating formwork comprise a connecting element which connects the two sheathing panels. This type of formwork can be devided into two main categories depending on the arrangement between the connecting elements and the sheathing panels.

The first category may be referred to as a hollow parallelepiped blocks. In this category, one can find a connecting element which is molded with the sheathing at the factory site and is sometimes referred to by the trademarks ARGISOL and MARENGO. The advantages of this first category is that it is not necessary to install the connecting elements at the building site since they are already molded at the plant or factory with the two sheathing panels. On the other hand, this type of formwork has serious disadvantages in terms of storage or transportation given the rather high volume/surface-of-formwork ratio.

The second category is referred to as the planar solid slab formwork. In this category the connecting elements are normally rigid and are supplied separately from the sheathing panels which are in the form of the planar solid slabs. Examples of this category is shown in U.S. Pat. Nos. 4,604,843 and 4,888,931 and Canadian Patent 1,233,042. The disadvantages of this category of formwork is that the connecting elements must be assembled at the building site which increases the installation cost of the formwork.

The formwork of both of these categories is subject to other disadvantages at the on-site installation, and that is the relative small dimensions of the modules. For example in order to erect a 10 $m^2$ formwork one must assemble 10 to 40 modules on site, depending on the type of formwork used, which increases the number of joints and the cost of installation. As far as the fabrication of these modules is concerned, various elaborate machining or molding procedures are required in order that the edges of the modules form proper joints on assembly.

Attempts to overcome these disadvantages have been made wherein the smaller modules are assembled at the factory site to form larger formwork sections and transporting these to the building site. In such a case one encounters transportation problems in view of the high volume to formwork surface ratio. That is a large volume of forms must be carried for a relatively small formwork surface. Each of the forms are of course spaced apart and held there by the rigid ties such that one lands up transporting a great deal of air.

On the other hand, once insulating formwork is being utilized, other tasks must be added such as the installation of reinforcement rods, vapor barrier, water proofing membranes, or filler strips. These additional tasks increase the installation costs and construction delays.

3. Summary of the Invention

It is an aim of the present invention to provide formwork which can be rapidly installed and which takes the advantages of the above mentioned two categories of insulating formworks without the disadvantages.

It is a further aim of the present invention to provide a prefabricated collapsible formwork which will reduce the amount of space required for storage or transportation as compared with the above prefabricated formwork.

It is further aim of the present invention to provide a prefabricated formwork which includes vapor barriers, waterproof membranes, insulation, reinforcement and filler strips already included at the factory site, thereby reducing the installation costs and construction delays at the building site.

It is a further aim of the present invention to provide prefabricated formwork modules which are of a greater size than those considered in the above two categories.

It is a further aim of the present invention to provide a prefabricated or preassembled collapsible formwork which one assembles at the building site and readies to receive concrete as well as the outside finish covering and the interior finish covering.

The construction in accordance with the present invention comprises a formwork for a vertical wall including a prefabricated formwork module for a vertical wall including a first sheathing panel, a second sheathing panel and a plurality of collapsible connecting elements anchored to each of the first and second sheathing panels and extending at least partially therebetween in a spaced apart relationship, the first and second sheathing panels including edges having joint means on edge areas for permitting the modules to be erected one to the other in edge to edge relationship, the formwork module and connecting elements being constructed such that during storage or transportation of the formwork modules, each formwork module is collapsed such that the first and second sheathing panel are adjacent one another with the connecting element collapsed and at the building site during assembly the first and second sheathing panels are spaced apart to the full extent of the connecting elements.

A method in accordance with the present invention comprises the steps of selecting a first sheathing panel having edges, selecting a second sheathing panel with edges to form a formwork module, attaching the first ends of a plurality of collapsible connecting elements to the first sheathing panel in a spaced apart relationship such that the connecting elements have opposite ends extending from the interior face of the first panel, connecting the opposite ends of the collapsible connecting elements to the second sheathing panel such that the interior face of the second panel faces the interior face of the first panel and collapsing the first and second sheathing panels against each other for storage and transportation while separating the first and second panels to the full extent of the connecting elements during assembly thereof at a building site. More particularly the method includes assembling a plurality of formwork modules, including providing joint means at the edge areas of contiguous sheathing panels of adjacent formwork modules.

In a more specific embodiment of the present invention there are provided bearing devices on the exterior of the first and second sheathing panels respectively and the connecting elements pass through the panels and abut the bearing devices. In a still more specific construction, the bearing devices are in the form of a filler strip and the sheathing panels are insulating panels. In a further specific embodiment, a concrete reinforcement in he form of a grid is assembled between the first and second sheathing panels at the factory site. Further, the vapor barrier and the waterproof membrane can be installed on the insulating sheathing panels at the factory site such that all of the component parts of the formwork can be preassembled at the factory site and the form can be collapsed for storage and transportation.

The erection of the formwork at the building site consists of separating the first ad second sheathing panels and by maintaining the separation by inserting spacers therebetween and connecting the joints at the edge areas of the panels with adjacent panels. In a more specific embodiment the spacers could be collapsible spacers which are preassembled at the factory site and which can be deployed at the building site when separating the first and second sheathing panels.

The invention is especially concerned with the preassembling of as many building components as possible on the formwork, at the factory site, and to use as much as possible, conventional building materials in order to avoid the necessity of molding processes such as for molding expandable polystyrene. It is an aim therefore to render the form construction as universal as possible.

Certain advantages which can be noted from the present invention include:

- Reduced storage and transportation costs since the formwork utilizes collapsible connecting elements allowing the formwork to be collapsed, thereby reducing their respective volume to formwork surface ratio;
- A rapid and simple assembly of the prefabricated panels, and in particular a larger size module when using insulating sheathing panels, thereby reducing the number of assembling steps on the building site and the number of joints for a given formwork surface. For example to erect 10 $m^2$ of formwork only three modules are required under the present invention instead of the current 10 to 40 modules.

The prefabrication of the sheathing panels is simple since no molding or machining of the panels is required. All that is required is to form holes through the sheathing panels.

A new form mating joint is described which offers resistance to traction and compression and this in two or three perpendicular directions. The system allows for rapid assembling and in case of errors an equally rapid disassembling of the modules.

Preassembling the vapor barriers, the waterproof membrane and the filler strips, both interior and exterior, as well as the concrete reinforcement at the factory site, eliminates having to provide for these steps at the building site, thereby reducing costs

BRIEF DESCRIPTION OF THE DRAWINGS

Having thus generally described the nature of the invention, reference will now be made to the accompanying drawings, showing by way of illustration, preferred embodiments thereof, and in which:

FIG. 10 is a fragmentary elevational view of another embodiment of a joint between two adjacent formwork modules;

FIG. 10A is an enlarged fragmentary vertical cross-section taken along lines C—C of FIG. 10;

FIG. 10B is a view partly broken away of a detail shown in FIG. 10;

FIG. 11 is a fragmentary elevational view of still another embodiment of a joint between two adjacent formwork modules;

FIG. 11A is an enlarged fragmentary vertical cross-section taken along lines D—D of FIG. 11;

FIG. 11B is a view partly broken away of the detail of FIG. 11;

FIG. 12 is a fragmentary elevational view of a joint between two formwork modules;

FIG. 12A is a view partly broken away of a detail of FIG. 12;

FIG. 12B is an exploded view in cross-section of the joint shown in FIG. 12;

FIG. 20 is a fragmentary elevational view of a further embodiment of the joint between two formwork modules;

FIG. 20A is a fragmentary horizontal cross-section taken along lines L—L of FIG. 20;

FIG. 20B is a fragmentary enlarged vertical cross-section taken along lines M—M of FIG. 20;

FIG. 20C is a view of a further detail of an element in FIG. 20;

DESCRIPTION OF THE PREFERRED EMBODIMENTS

Figure 1:
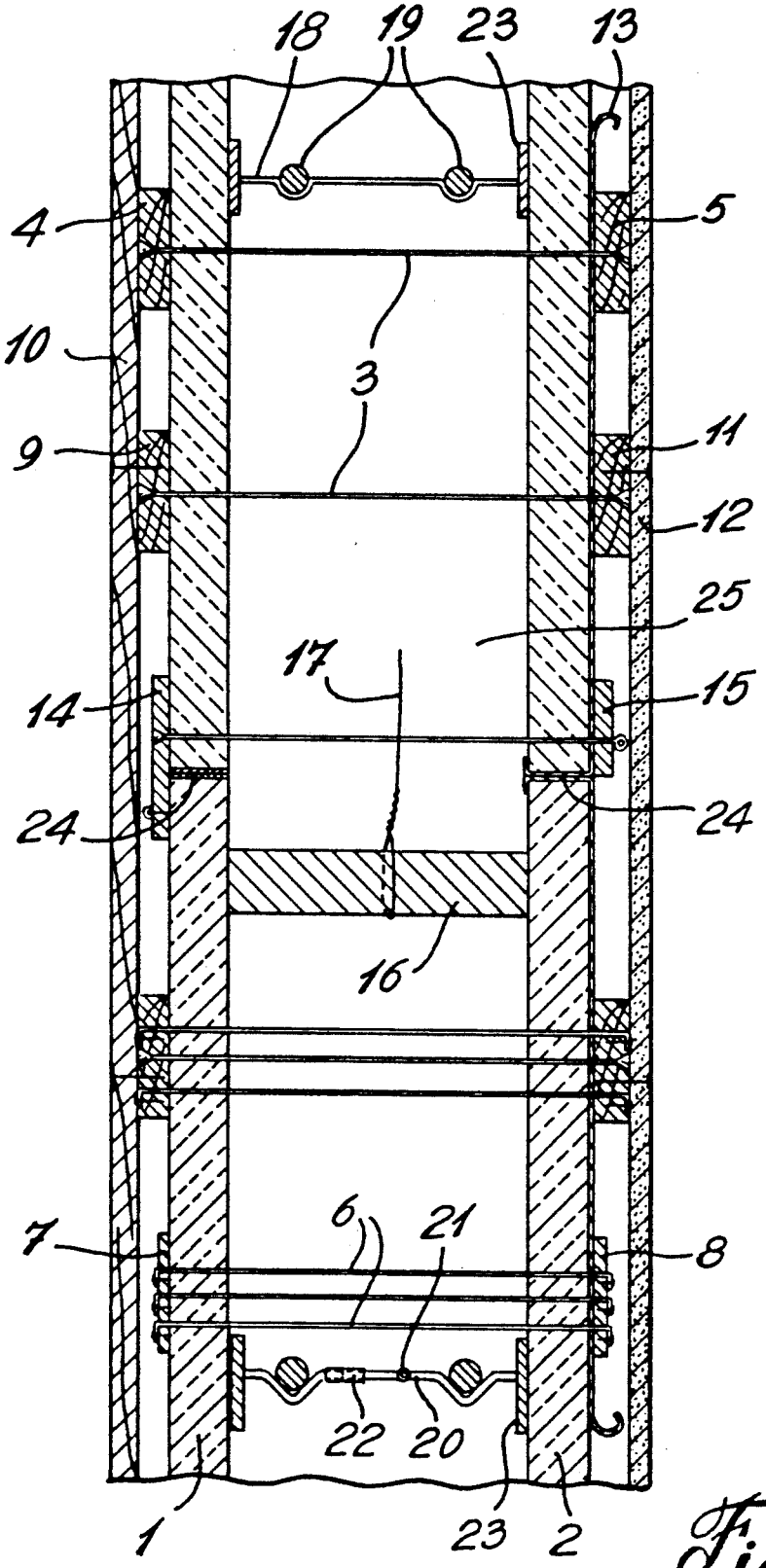
FIG. 1 is a fragmentary vertical cross-section of a formwork for a concrete frame building having a wooden exterior facing and a gypsum panel interior facing in accordance with the present invention.

Referring now to the drawings and in particular to FIG. 1, fragments of two formwork joined together at a building site are illustrated wherein each formwork has an exterior sheathing panel 1 made of expanded polystyrene (EPS). An opposite interior sheathing panel 2 of similar insulating material is also shown. The exterior panel 1 and interior panel 2 are held together by flexible connecting elements 3.

These flexible connecting elements 3 illustrated in the embodiment of FIG. 1 are made from multi strand metal cable. It is understood that the connecting elements can be made of other types of materials such as plastic. The connecting element 3 is meant to abut the exterior of sheathing panel 1 against a bearing block 4 and sheathing panel 2, against a bearing block 5. These bearing blocks 4 and 5 can be fabricated out of wood having square outline and dimensions of 89 mm×89 mm by 19 mm. It is understood that these bearing blocks can also be made of metal, plastic, or other material having the necessary structural resistance and the shapes and dimensions could be different. The connecting elements 3 are passed through the panels 1 and 2 to abut in the bearing blocks 4 and 5 as shown in the drawings. These are assembled at the factory site so that the formwork is prefabricated before shipping It is important that the connecting elements 3 be at least foldable so that the panel 2 can be collapsed onto the panel 1 for instance in the storage or transportation condition and then be expanded to the full extent of the connecting member 3 at the building site when it is being assembled.

Another embodiment of the connecting elements is illustrated in FIG. 1 and this includes connecting elements 6 which are made up of a plurality of metallic monofilaments grouped together but spaced apart one from the other. These connecting elements retain the respective sheathing panels 1 and 2 by means of bearing blocks 7 and 8 respectively, also illustrated in FIG. 1. The bearing blocks 7 and 8 as illustrated are made of wood as are the bearing blocks 4 and 5. However the bearing blocks 7 and 8 are much thinner than the blocks 4 and 5 in view of the fact that the connecting elements 6 include several spaced monofilaments located at different locations on the bearing blocks 7 and 8. In the case of connecting elements 3, they are located at one location and either of blocks 4 and 5. These bearing blocks 4 and 5, and 7 and 8 are considered discontinuous blocks.

On the other hand, the exterior surfaces of the sheathing panels 1 are provided with continuous all-purpose filler strips 9. These blocks are strips 9 having in the present embodiment a thickness of 19 mm and a width of 89 mm. The filler strip 9 is used for nailing the exterior wooden facing 10 and has a support for the sheathing panel and referred to as a continuous bearing strip A similar multi- purpose filler strip 11 is provided on the interior sheathing panel 2 and a connecting element 3 is connected to both filler strips 9 and 11. The filler strip 11 is used as a base for receiving screw-type fasteners for the interior gypsum panels 12 and for retaining the vapor barrier 13 which is mounted to the panel 2 at the factory site.

Respective formwork modules are connected together at joint 24, that is at the edges of the respective sheathing panels 1 and 2. In the embodiment of FIG. 1 a male joint member 14 and female joint member 15 help to locate the panels at the joint 24. These elements 14 and 15 clearly can be made of wood as shown in the drawings or of metal or plastic or other combination of materials.

The two sheathing panels 1 and 2 making up the formwork are held at a spaced-apart position against the connecting elements 3 by means of spacers. In FIG. 1, spacer 16 is placed therein at the building site during assembly. A string 17 is provided to remove the spacer 16 when it is no longer required.

Spacer 18 is a permanent spacer installed in the form at the building site. The spacer 18 is shown with two notches for receiving reinforcement rods 19, and this combination is allowed to be lost in the concrete when it is poured.

Another embodiment of the spacer is illustrated by the numeral 20. The spacer 20 includes a hinge 21 and a locking device 22 which locks the spacer 20 in its extended position when the formwork is installed at the building site. Spacers 18 and 20 are provided with plates 23 which are in contact with the interior faces of the sheathing panels 1 and 2. The concrete 25 is poured into place between sheathing panels 1 and 2. All of the components are pre-assembled at the factory site with the exception of spacers 16, 18 and 20 which are installed at the building site. The reinforcement rods 19, the concrete 25 and the gypsum panels 12, as well as the exterior wood facing 10 are installed at the building site.

Figure 2:
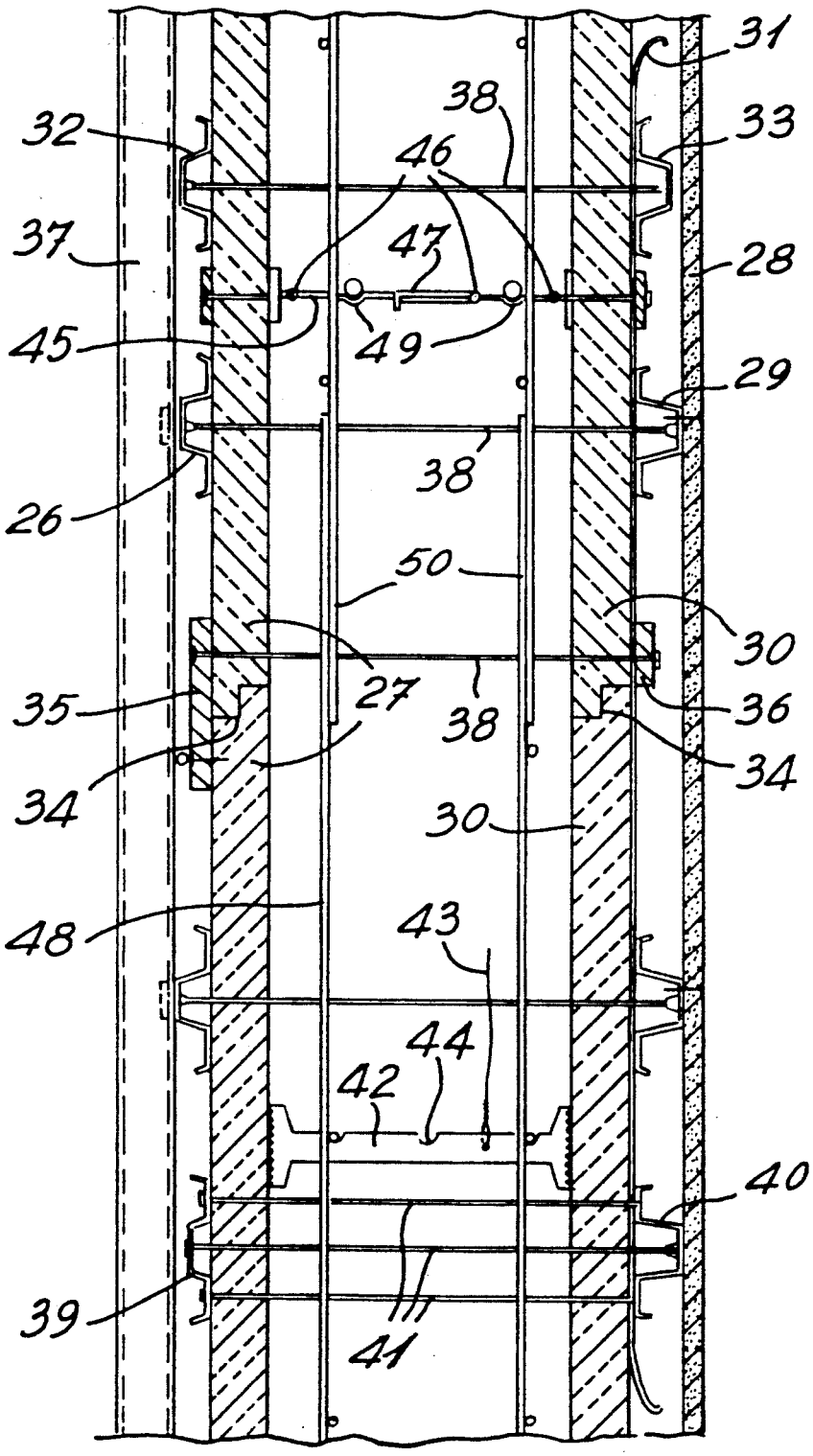
FIG. 2 is a fragmentary vertical cross-section of another embodiment of the present invention and showing a metallic exterior facing and a gypsum panel interior facing.

Referring now to FIG. 2 the external metallic facing 37 is fixed to metal filler strip 26. The filler strip 26 is a multi-purpose bearing strip that helps to support the exterior sheathing panel 27. The interior gypsum panels 28 are fixed to metallic filler strip 29 which is also a multi-purpose bearing strip which helps to support the interior sheathing panel 30 and which holds the vapor barrier 31 to the panel 30.

The sheathing panels 27 and 30 are also held by the discontinuous bearing members 32 and 33. The bearing members 26, 29, 32 and 33 are connected by means of connecting elements 38 which are cables. The bearing blocks 39 and 40 are connected by connecting element 41 which is made up of a number of spaced-apart monofilaments wires. The bearing elements can be made out of metal as shown in FIG. 2 or can be made out of other materials.

The joints 34 are in the form of rabbet joints and the male joint elements also are bearing blocks as are the joint elements 36 to which a connecting element 38 is associated. Prefabricated temporary spacers 42 which are installed at the building site are provided to maintain the two sheathing panels 27 and 30 in their spaced extended position at the building site. Spacer 42 is provided with a wire 43 for the purpose of removing the spacer when it is no longer required The spacer is provided with a notch 44 to facilitate the installation thereof at the building site.

The spacers 45 which also serves to separate the sheathing panels 27 and 30 are installed at the factory site and are deployed at the building site. The spacer 45 includes a mechanism provided with three hinges 46 and is provided with a blocking device 47.

The concrete reinforcing structure 48 is assembled at the factory site in the form of a metallic trellis or grid. This grid 48 is parallel to the sheathing panels 27 and 30 and can be conveniently collapsed for storage and transportation when the panels 27 and 30 are collapsed against each other with the metallic grid work 48 sandwiched therebetween. When the formwork are being assembled at the building site the reinforcing grid 48 is properly located in a spaced relationship with the help of the notches 49 provided in the spacers. At the joints of the various formwork modules, the metallic reinforcing grid is overlapped as shown at 50.

Figure 3:
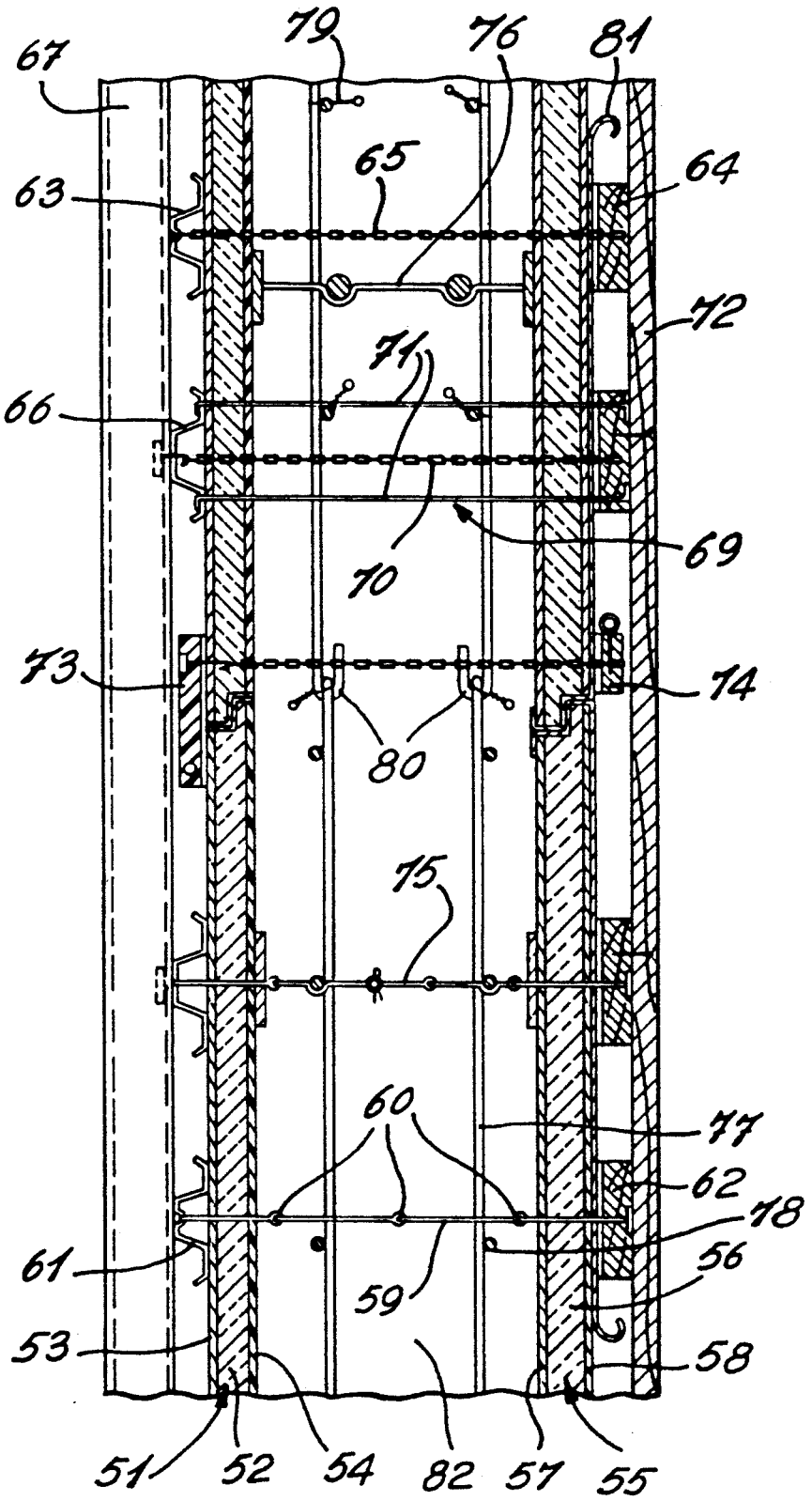
FIG. 3 is a fragmentary vertical cross-section of still another embodiment of the present invention and showing a metallic exterior facing and a wood panel interior facing.

FIG. 3 shows a similar formwork with an exterior sheathing panel 51 made up of a rigid insulating material, i.e. expanded polystyrene (EPS) as a core 52 sandwiched between reinforcement coatings 53 which can be a wood chip sheet on the exterior face and a polymeric reinforcement coating 54 on the interior surface of the panel 51. These coatings are of course provided at the factory site.

The interior sheathing panel 55 is made up of a composite material including a core 56 and coatings 57 and 58 which are held together by a chemical adhesive or by mechanical fasteners. For example the core 56 can be an extruded polystyrene material while the coating 57 is a pressed wood fiber glued to the core 56 and the coating 58 is a two-ply plywood glued to the core 56. The external sheathing panel 51 and the internal sheathing panel 55 are connected by means of collapsible connecting elements 59 which are rigid links connected by means of three hinges 60. The connecting element 59 is mounted to the sheathing panels 51 and 55 at the factory site along with the discontinuous bearing blocks 61 made out of plastic and the bearing blocks 62 made out of wood. The plastic bearing block 63 is connected to the wooden bearing block 64 by means of a flexible connecting element 65. The flexible connecting element 65 in this embodiment is made of a chain with metal chain links. The multi-purpose filler strips 66 serve as bearing blocks for the connecting elements 69 and also serve to receive screws for mounting the outer metallic facing 67. The filler strip 66 is attached to the filler/-bearing block 68 by a collapsible connecting element 69 which is made up of a metallic chain 70 and several metal cables 71 in spaced apart relationship.

The interior facing can be in form of a stained wood panel 72 fixed to the wooden filler strip 68 which is also a bearing block for the internal sheathing panel 55. The formwork joints are shown as rabbet joints at the edges of the panels 51 and 55 and are provided with bearing block 73 made out of plastic which also serve as the male joint elements. The bearing block 74 also serves as the female joint element and this is made out of wood and mounted to the panel 55. The elements 62, 64, 68 and 74 also retain the vapor barrier 81.

The spacing of the panels 51 and 55 is provided by a link-spacer 75 having hinges and blocking mechanisms. The link-spacer 75 can also serve as a connecting element and is connected to filler members acting as bearing blocks as shown in the drawings. This link-spacer 75 is mounted at the factory site and deployed at the building site. The concrete reinforcing grid is installed at the factory site and includes a grid pattern of rods welded at 78 or by mechanical fasteners 79. The joints of the reinforcing grid is formed at the factory site by providing hooks 80. All of the components are preassembled at the factory site with the exception of the metallic exterior facing 67, the stained wood finishing facing 72 and the concrete 82 which is poured in situ.

Figure 4:
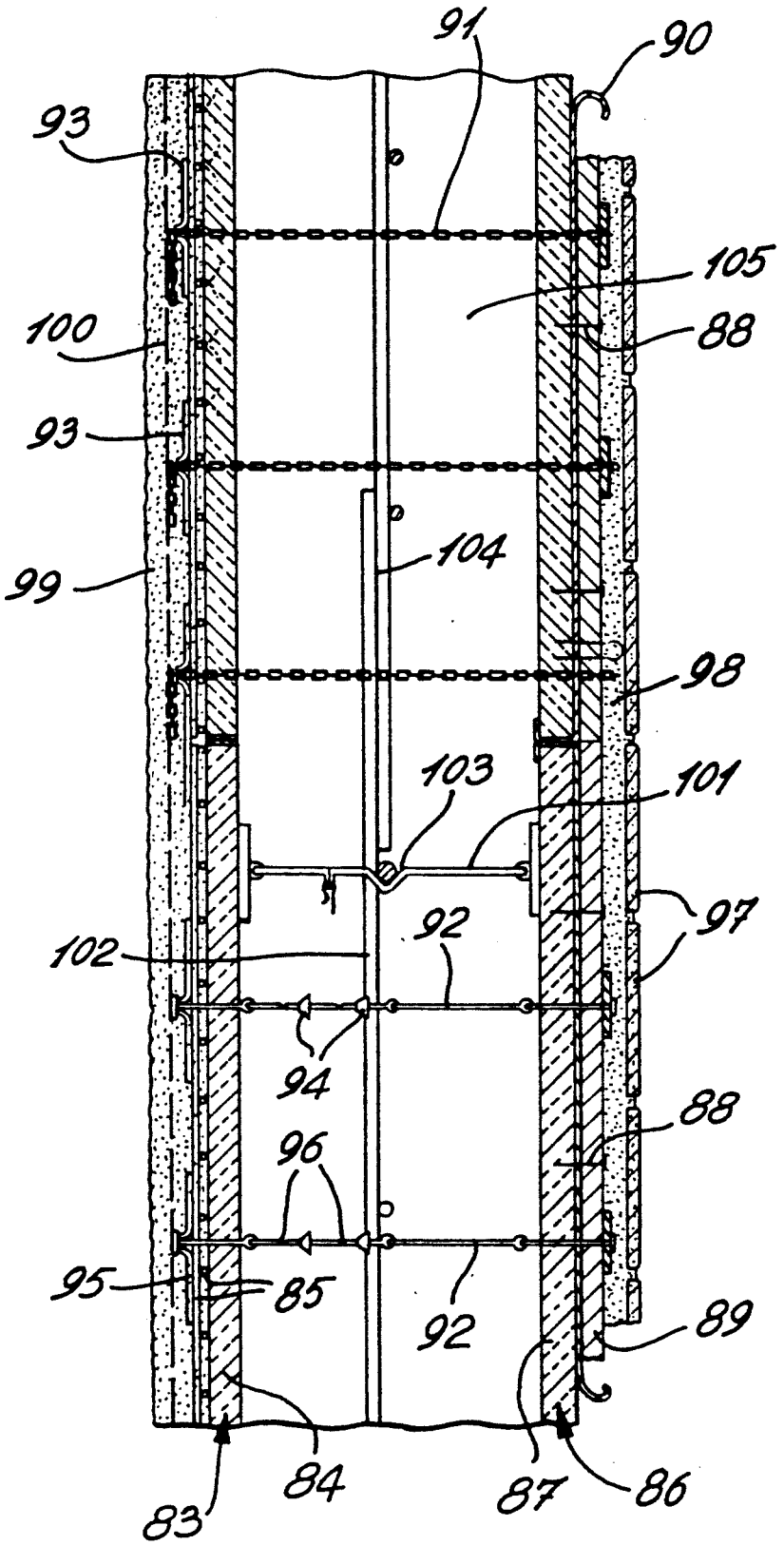
FIG. 4 is a fragmentary vertical cross-section of still another embodiment of the present invention and showing an exterior stucco facing and an interior ceramic tile facing.

Referring now to FIG. 4 the exterior sheathing panel 83 is composed of an insulating material such as expanded polystyrene (EPS) 84 and a reinforcement grid 85. The reinforcement grid 85 is attached to the insulating panel 84 by mechanical fasteners or by chemical adhesives and the assembly thereof is done at the factory site. The internal sheathing panel 87 is composed of a rigid insulating panel 86 attached to a wood-chip panel 89 by means of mechanical fasteners 88. The vapor barrier 90 is installed at the factory between the layers 87 and 89.

The two sheathing panels 83 and 86 are connected together by means of collapsible connecting members such as chain 91. Connecting element 92 is in the form of rigid links articulated at hinges. The length of the flexible elements 91 or 92 can be adjusted. For instance the chain 91 or member 92 is coupled through a discontinuous retaining member having a deformable opening in one direction. The numeral 93 represents this device and allows the possibility of adjusting the distance between the two sheathing panels of this formwork The connecting element 92 includes rigid links with hinges and has graduations 94 with weak points 96 in order to break off the length at predetermined lengths. The graduations 94 on the connecting element 92 can be coupled to a retaining device 95 having a deformable opening in one direction allowing the possibility of adjusting the length of the connecting element 92. The interior ceramic tiles facing 97 can be applied directly to the wood chip panel 89 with suitable glue or a mortar coating 98. The exterior facing 99 is made out of stucco reinforced with metallic slats 100.

Spacing between the sheathing panels 83 and 86 is provided by means of the hinged spacer member 101 which is mounted at the building site. The concrete reinforcement is in the form of a metallic grid 102 maintained in place by means of the notches 103 on spacer 101. The joint of the grid is provided at the building site by allowing the overlapping of the grids at 104. The concrete is poured between the sheathing panels 83 and 86. As in other embodiments, all of the elements are preassembled at the factory site with the exception of the exterior and interior facings.

Figure 5:
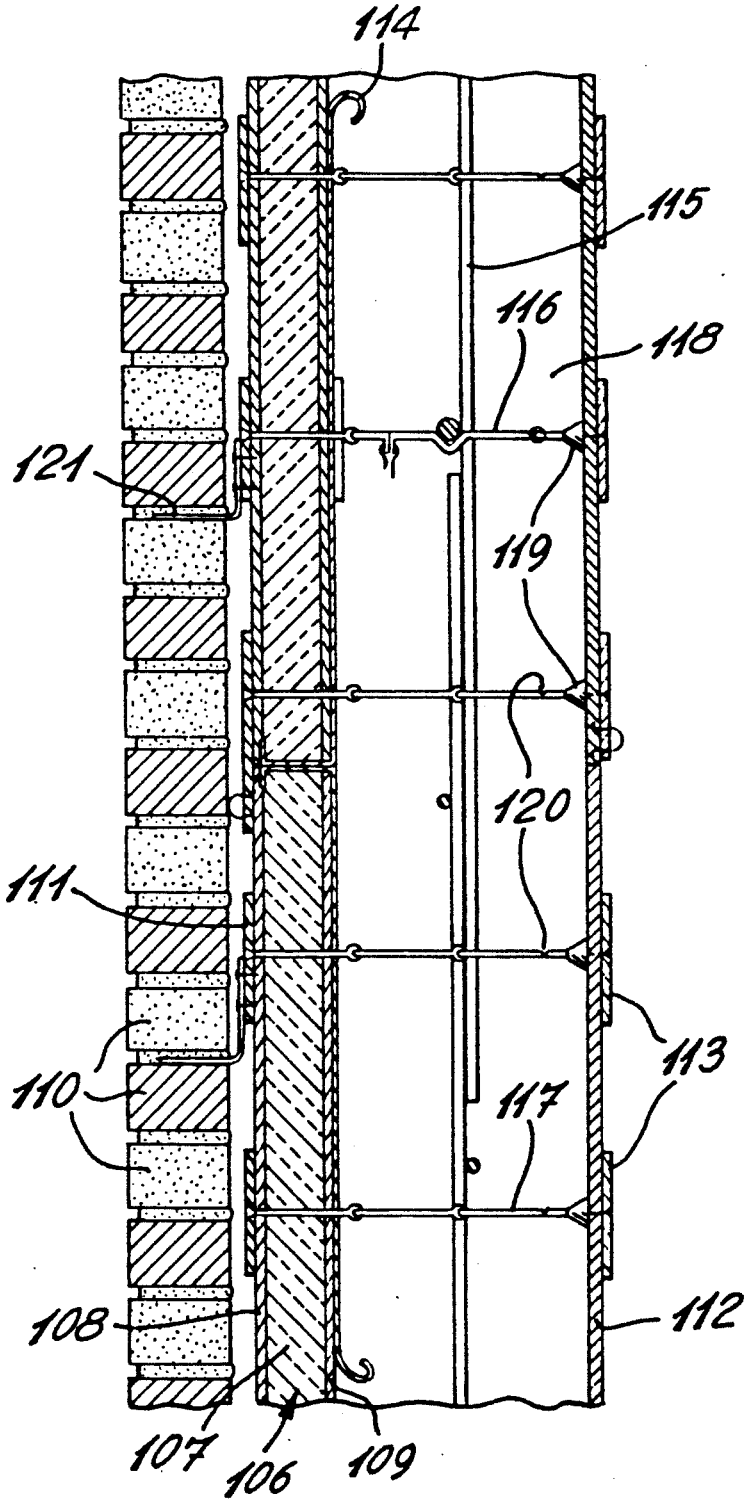
FIG. 5 is a fragmentary vertical cross-section of the present invention and showing yet another embodiment thereof and illustrating a brick exterior facing and an interior concrete facing.

FIG. 5 illustrates another embodiment of the formwork wherein exterior sheathing panels 106 comprises a rigid insulating panel of expanded polystyrene (EPS) 107 and a layer of wood chips 108 on the exterior surface thereof as well as on the interior surface 109. The exterior facing 110 is of brick and is connected to the bearing blocks 111 by conventional masonry connecters 121.

The interior facing in this embodiment is the concrete wall. In order to obtain this interior facing, the interior sheathing panel 112 can be a new panel with a smooth interior surface in contact with the concrete. In order to reduce the purchase costs of a new panel 112 the bearing blocks 113 can be increased in size in order to allow for the reduction of the thickness of the sheathing panel 112 which is disposable. The sheathing panel 112 in this embodiment can be made of composite sheets such as MASONITE (trademark) or other similar material. The vapor barrier 114 is fixed to the sheathing panel 106 at the factory site. The concrete reinforcement structure 115 is assembled at the factory site in the form of a grid.

The spacing between the sheathing panels 106 and 112 is provided by means of a link-spacer 116 which is collapsible and includes three hinges. The bearing blocks 111 and 113 are connected by means of connecting element 117 which is a collapsible link structure having hinges. After the concrete has been poured and the minimum curing time has passed, the temporary sheathing panel 112 as well as the bearing blocks 113 are removed. The connecting elements 117 and spacer 116 are provided with cones 119 and a weak point 120 allowing the devices to be broken off at a predetermined distance from the surface of the concrete.

Figure 6:
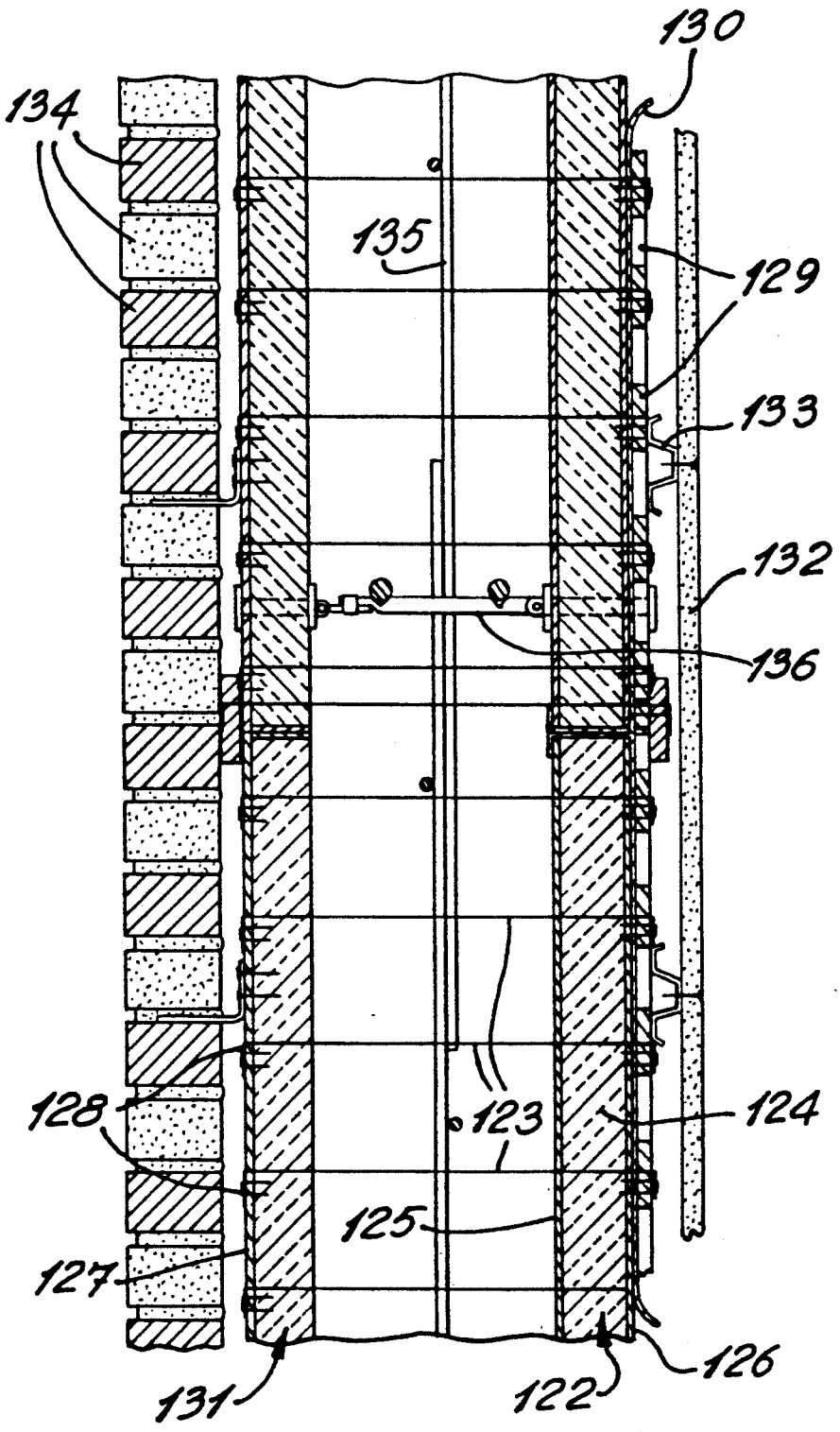
FIG. 6 is a fragmentary vertical cross-section of still another embodiment of the present invention and showing an exterior brick facing and an interior gyspsum panel facing.

Reference will now be made to FIG. 6 which shows an exterior sheathing panel 131 connected to the interior sheathing panel 122 by collapsible connecting elements 123 which are of the flexible type. The sheathing panel 122 comprises a expanded polystyrene material (EPS) providing an insulated panel 124 covered with reinforcement coatings 125 and 126. The sheathing panel 131 is supported by two dimensional continuous support panel 127. This panel 127 can be made of a thin wood chip material or other similar material. The connecting element 123 is anchored to continuous bearing device 127 by mechanical anchors 128.

The interior sheathing panel 122 is supported by a two dimensional continuous bearing panel 129. The vapor barrier 130 is retained by the panel 129. The interior facing is a gypsum panel and is fixed by means of a metal filler strip attached to the panel 129 at the factory site. The sheathing panel 131 and 122 are spaced apart by means of link-spacers 136. The exterior facing 134 is of brick and is connected to the continuous support device 127 by means of masonry connectors. The concrete is poured in situ and is reinforced by means of the metal grid 135 which is preassembled at the factory site.

Figure 7:
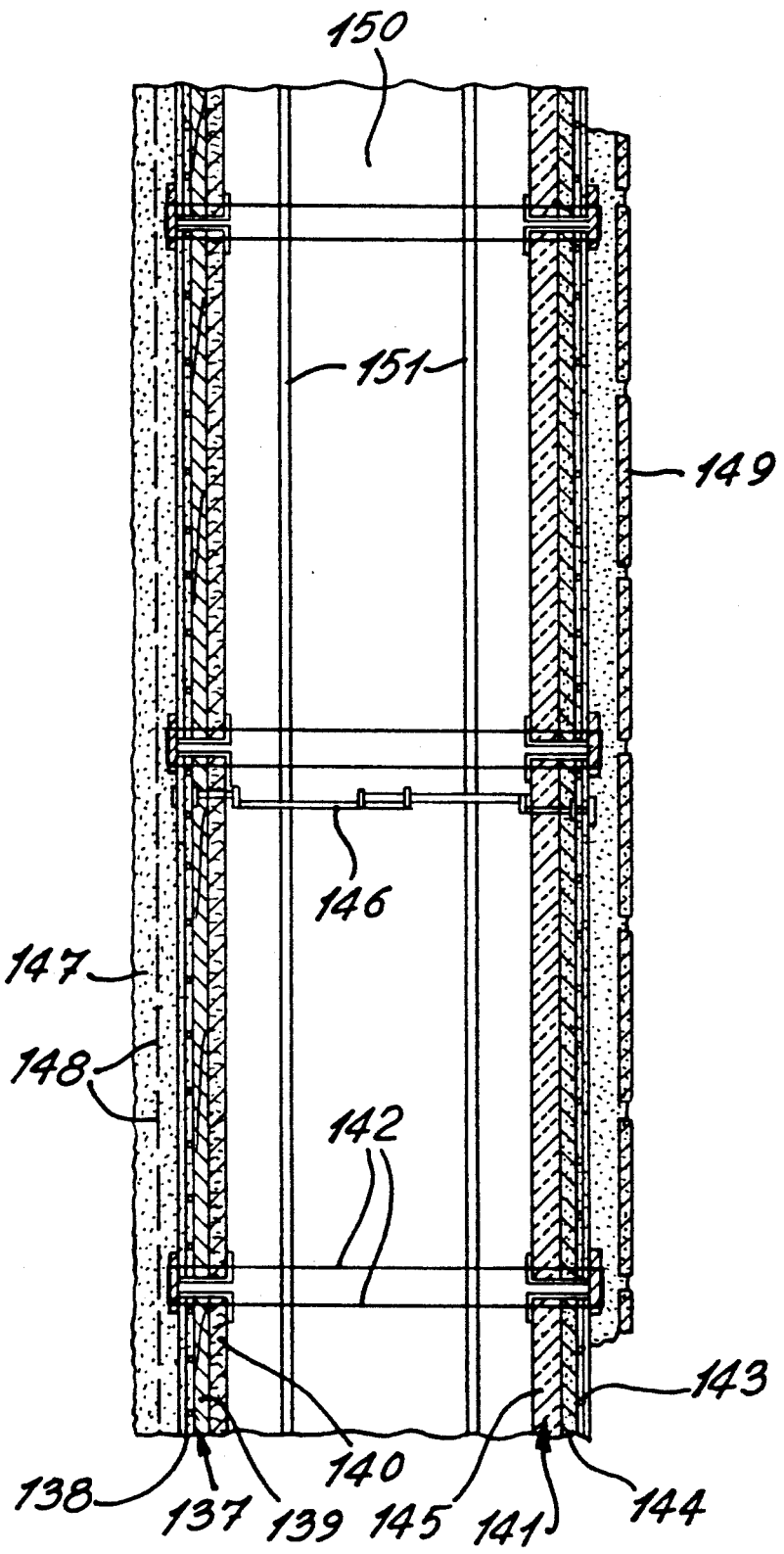
FIG. 7 is a vertical cross-section of still another embodiment of the present invention and having a stucco facing on one side thereof and a ceramic tile facing on the other side thereof.
Figure 8B:
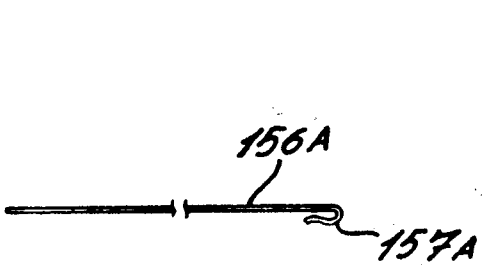
FIG. 8B is a view partly broken away of a detail shown in FIG. 8.
Figure 8A:
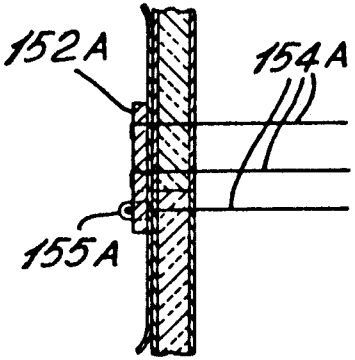
FIG. 8A is a fragmentary enlarged vertical cross-section taken along lines A—A of FIG. 8.
Figure 9B:
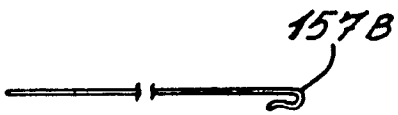
FIG. 9B is a view partly broken away of a detail shown in FIG. 9.
Figure 9A:
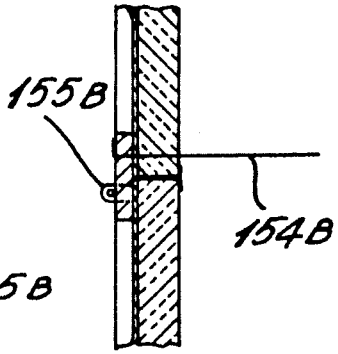
FIG. 9A is an enlarged vertical cross-section taken along lines B—B of FIG. 9.
Figure 8:
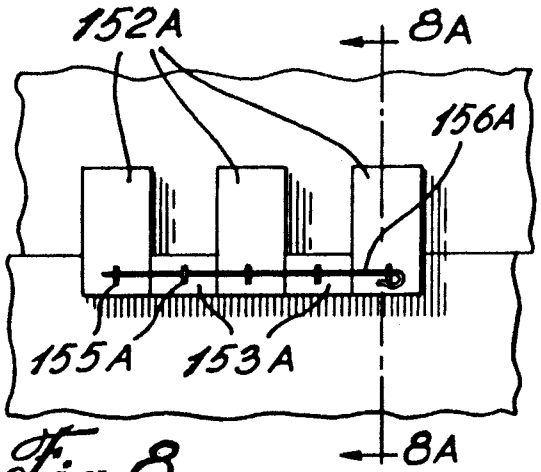
FIG. 8 is a fragmentary elevational showing a joint between two adjacent formwork modules of the present invention.
Figure 9:
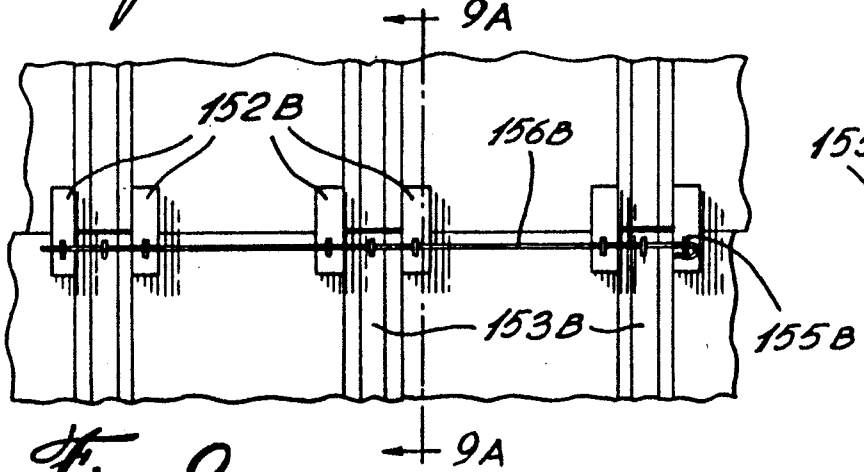
FIG. 9 is a fragmentary elevational view of another embodiment of a joint between two adjacent formwork modules.
Figure 13:
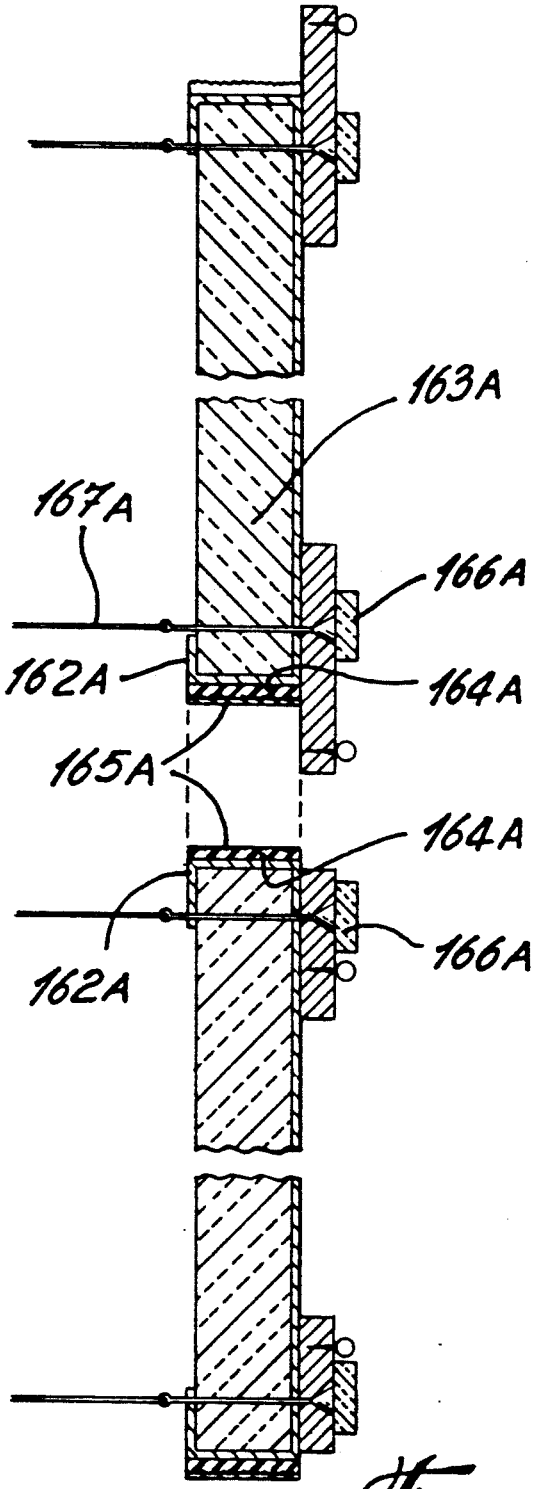
FIG. 13 is a vertical exploded cross-sectional view, partly broken away, and showing a joint in accordance with an embodiment of the present invention.
Figure 14:
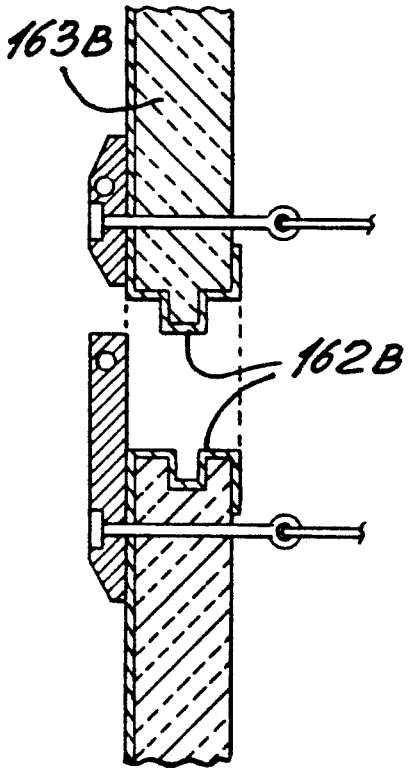
FIG. 14 is an enlarged exploded cross-sectional view similar to FIG. 13 but showing another embodiment thereof.
Figure 15A:
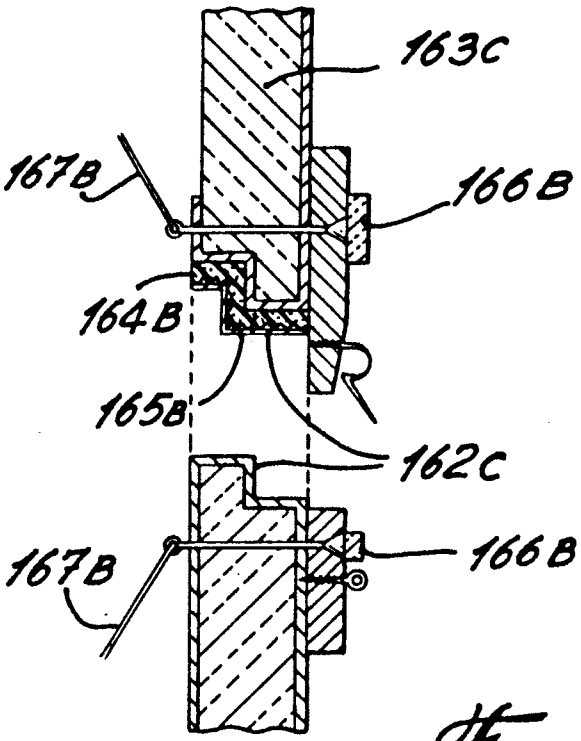
FIG. 15A is a fragmentary enlarged vertical cross-section taken along lines E—E of FIG. 15.
Figure 15:
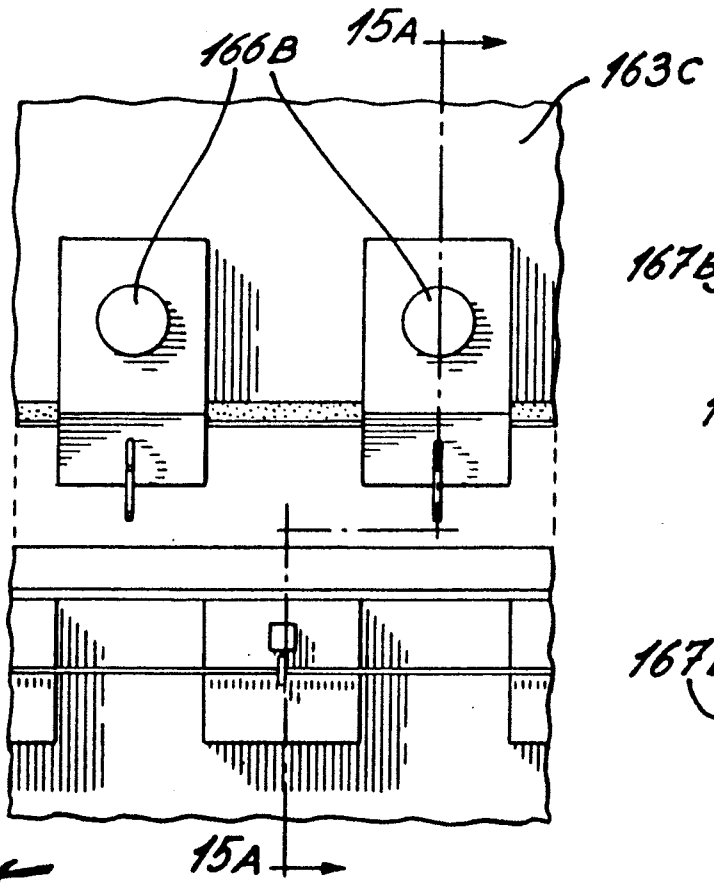
FIG. 15 is a fragmentary elevational view showing a joint of another embodiment of the sheathing panels of adjacent formwork modules.

FIG. 7 shows a sheathing panel 137 composed of a plastic grid 138, a wood chip panel 139 and a fiber board 140. The panel 137 is connected to the sheathing panel 141 by means of collapsible connecting elements 142. The sheathing panel 141 is composed of a wood grid 143, a gypsum panel 144, and a rigid insulating panel 145. The grids 138 and 143 are assembled at the factory site with the connecting elements 142 and the link-spacers 146. The other components are assembled at the building site according to specific requirements of each project and depending on the availability of the materials. The grids 138 and 143 are the primary bearing elements. These primary elements 138 and 143 can be of plastic or wood, such as indicated, or can be made of metal or other suitable material. The stucco 147 is reinforced by metal slats mounted to the sheathing panel 137. The ceramic tiles 149 are applied to the panel 141. The concrete is poured in situ and is identified by the numeral 150. The concrete is reinforced by means of reinforcement rods 151.

FIGS. 8, 8A, 8B, 9, 9A, 9B, 10, 10A, 10B, 11, 11A, 11B illustrate the joints between the various formwork modules at the building site. Longitudinal movement at the joint of the respective modules is prevented by means of male joint members 152A, 152B, 152C and 152D which are coupled with the female joint members 153A, 153B, 153C and 153D. These devices are also bearing blocks for the sheathing panels. The bearing devices are connected to the other sheathing panel by connecting elements 154A, 154B, 154C and 154D. The movement of the joint in the two transversal directions is prevented by female joint members 155A, 155B, 155C and 155D which are coupled with the male joint devices 156A, 156B, 156C and 156D. These male joint devices with respect to the transversal joint have an opening and closing feature which is based on deformation of the materials 157A, 157B, 157C and 157D. These components can all be composed of wood, plastic, metal, or other materials. In the drawings, for example, the components 152A, 153A, 152B and 152D are made of wood. Components 156B, 157B, 152C, 153C, 155C, 156C, 157C and 153D are plastic and components 155A, 156A, 157A, 154A, 153B, 155B, 154B, 154C, 154D, 156D, 157D are metal.

FIGS. 12, 12A and 12B show a male longitudinal joint device 158 coupled with female joint device 159. The female transverse joint device 160 is fixed to the male device 158. Under a small amount of pressure, the device 160 opens and closes the male transverse joint device 161.

Reference to FIGS. 13, 14, 15 and 15A. The vapor barriers or the waterproof membrane 162A, 162B and 162C are glued to the panels 163A, 163B and 163C through the thickness of the joint. An adhesive 164A and 164B is applied at the factory site. This adhesive is protected by a protecting paper 165A and 165B which is removed at the building site. An insulating device 166A and 166B breaks the thermal bridge with the connecting elements 167A and 167B which is made out of metal.

Figure 16A:
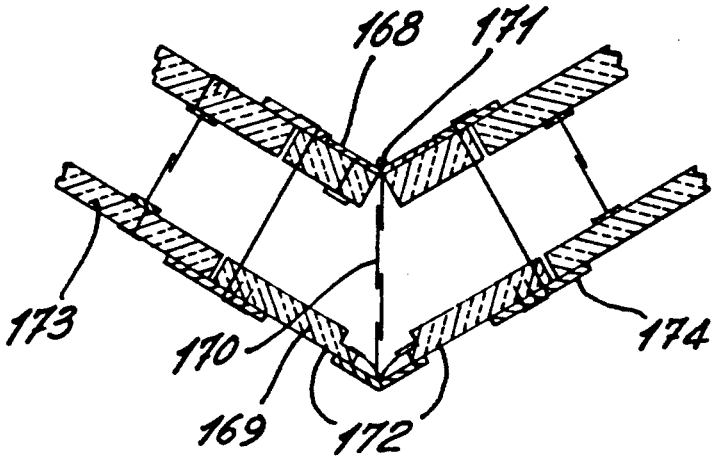
FIG. 16A is a horizontal cross-section taken along lines F—F of FIG. 16.
Figure 16:
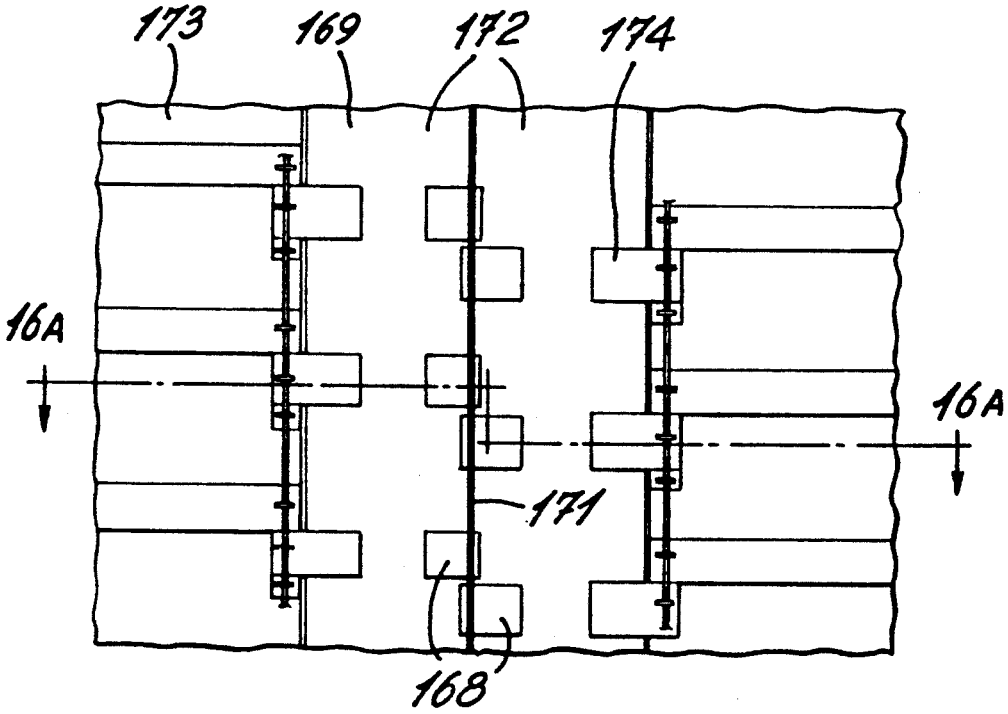
FIG. 16 is an elevational fragmentary view of a corner module for the formwork of the present invention.

Referring to FIGS. 16 and 16A. The corner hinges 168 are mounted at the factory site with panels 169 to form the exterior wall of the corner and the interior wall of the corner. These are connected by link-spacer elements 170 of the collapsible type which are connected to the hinged shaft 171. This assembly provides a variable angled module 172 which can be connected to contiguous modules, including sheathing panels 173 by joints 174.

Referring now to FIGS. 17, 17A, 17B and 17C, the joints are shown as permitting longitudinal movement along the axis of the joint for a predetermined distance. This limited distance is as defined between the bearing devices 175 and 176. This provides for adjustment in case of imperfections in regard to the adjacent surfaces due for instance to the footings which might not be at level. The bearing devices 175 and 176 are connected from one sheathing panel to the other by means of a flexible connecting element 177. The movement of the joints in the transverse direction at the joint is prevented by the transverse female member 178 of the joint which are coupled with the male transverse joint device 179. A waterproof membrane 180 is applied at the factory site on all the exterior surfaces of the sheathing panels which are not in contact with the concrete. The membrane 180 can be in asphaltic emulsion or it can be of some other similar material.

Figure 17C:
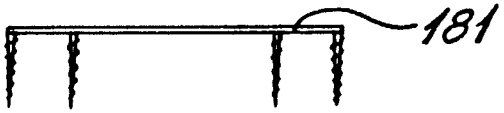
FIG. 17C is a view of a further detail of an element shown in FIG. 17.
Figure 17A:
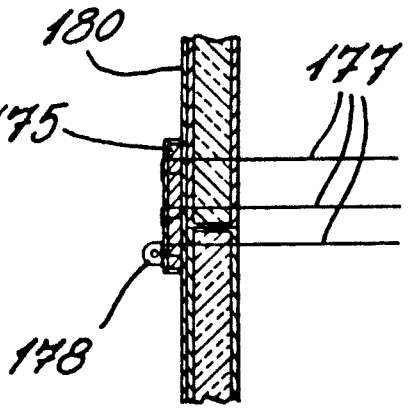
FIG. 17A is a fragmentary vertical cross-section taken along lines G—G of FIG. 17.
Figure 17B:
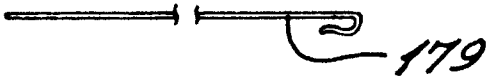
FIG. 17B is a view partly broken away of a detail of FIG. 17.
Figure 17:
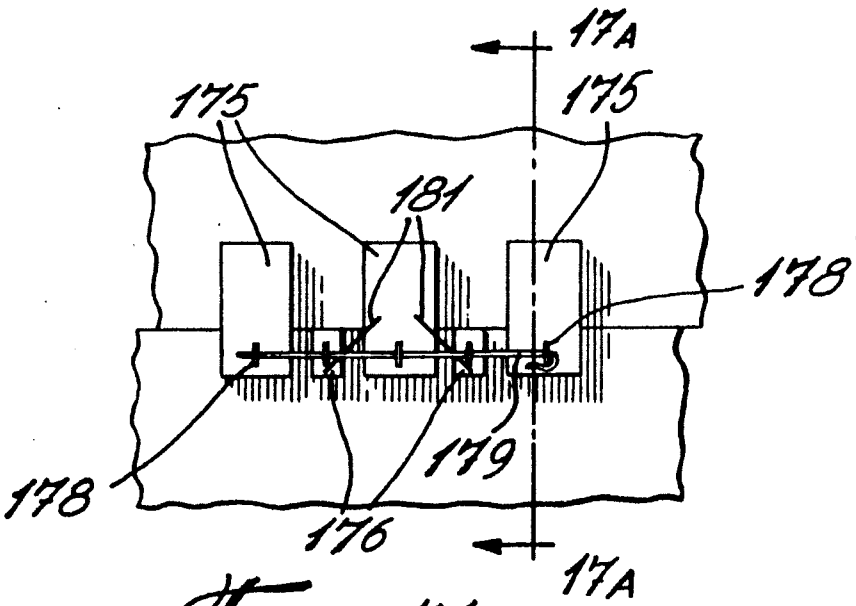
FIG. 17 is a fragmentary elevational view of a joint in accordance with a further embodiment of the present invention.

After the modules, including the sheathing panels, are assembled and adjusted the panels are fixed together by means of fasteners 181 as shown in FIG. 17C, by means of a hammer.

Figure 18A:
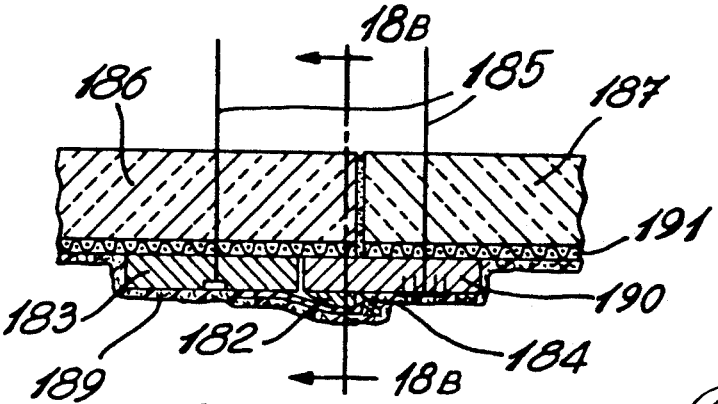
FIG. 18A is a horizontal cross-section taken along lines H—H of FIG. 18.
Figure 18C:
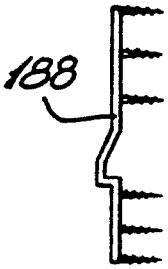
FIG. 18C is a view showing a detail of FIG. 18.
Figure 18:
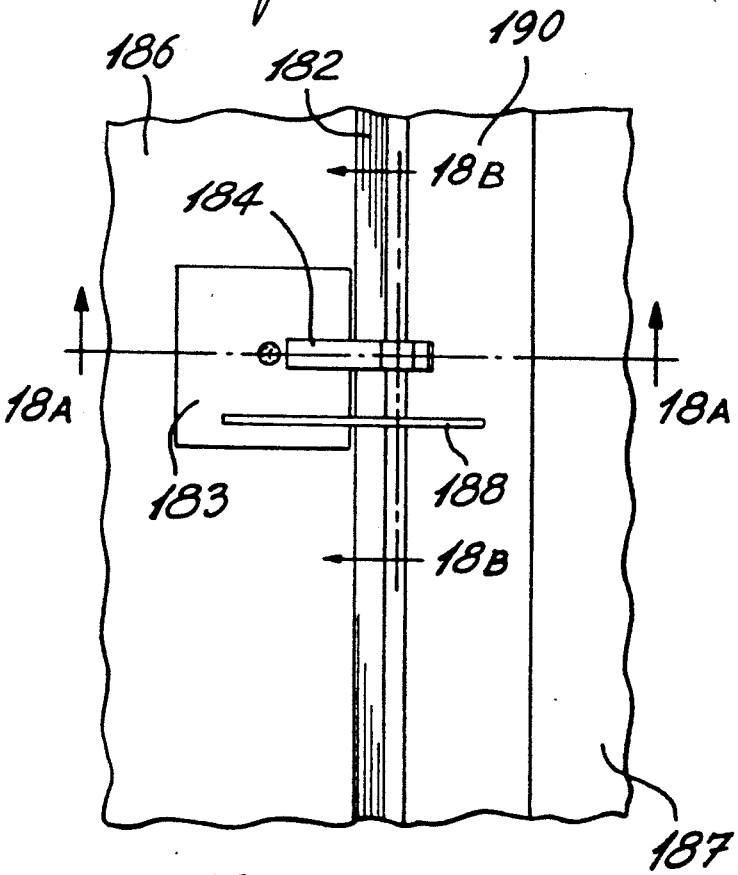
FIG. 18 is a fragmentary elevational view of a further embodiment of the joint between two formwork modules.
Figure 18B:
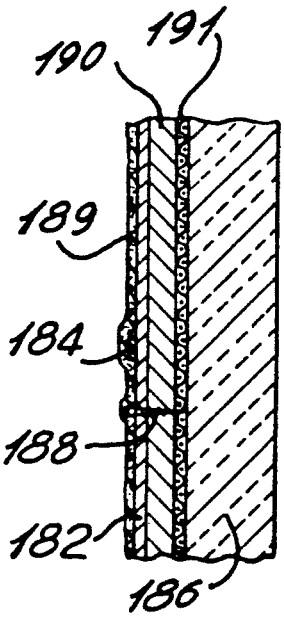
FIG. 18B is a fragmentary vertical cross-section taken along lines I—I of FIGS. 18 and 18A.
Figure 19A:
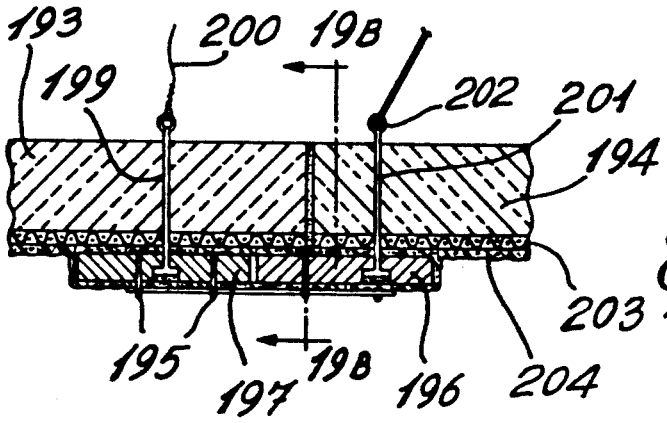
FIG. 19A is a fragmentary enlarged horizontal cross-sectional view taken along lines J—J of FIG. 19.
Figure 19:
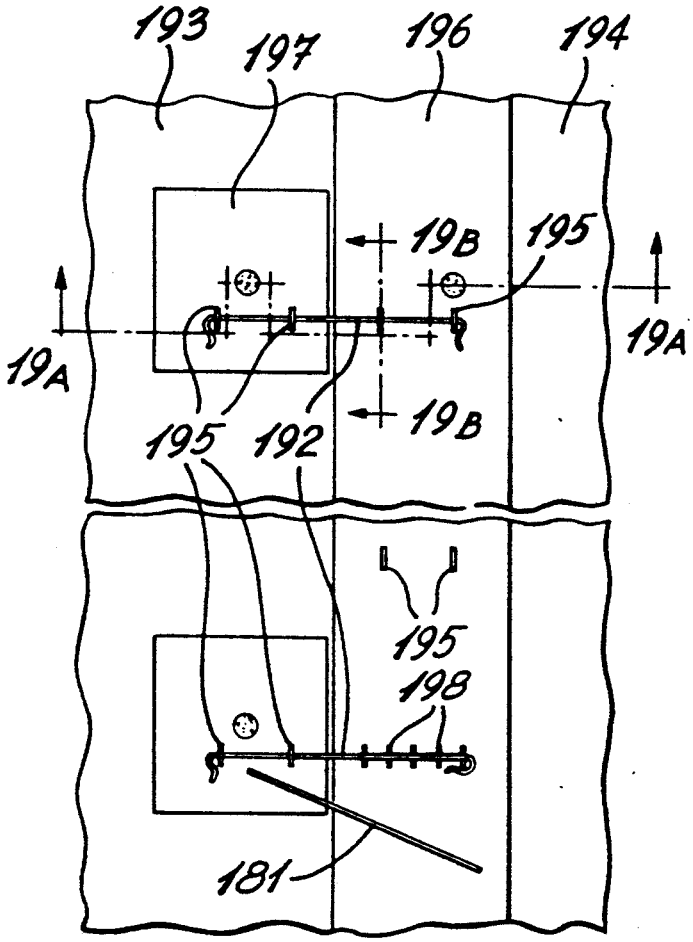
FIG. 19 is a fragmentary elevational view of still a further embodiment of a joint between two formwork modules in accordance with the present invention.
Figure 19B:
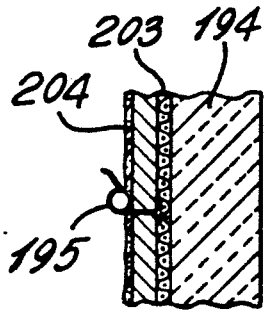
FIG. 19B is a fragmentary enlarged vertical cross-sectional view taken along lines K—K of FIGS. 19 and 19A.
Figure 19C:
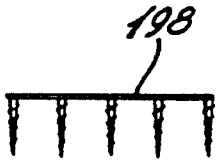
FIG. 19C is a view showing a further detail of an element in FIG. 19.

FIGS. 18, 18A, 18B and 18C show a joint which provides for unlimited longitudinal movement along the axis of the joint because the bearing device 190 and the retaining member 182 extend along the length of the axis of the joint. The bearing device 183 is provided with a retaining means 184 which is coupled with the retaining device 182 to prevent against movement in the two transverse directions. With only light pressure, the retaining device 184 is opened and can be closed on the retaining member 182. The bearing devices 190 and 183 are connected to similar bearing devices on the other opposed sheathing panel forming the formwork by means of collapsible connecting elements 185. After the sheathing panels 186 and 187 of the respective modules have been adjusted in the longitudinal direction any further movement is prevented by applying fastener 188 by use of a hammer, at the building site. The fastener 188 is applied to the bearing devices 190 and 183 respectively. The fastener is illustrated in FIG. 18C.

The waterproof membrane 189 is made of asphaltic emulsion and is applied at the factory site on all of the exterior surfaces of the sheathing panels which are not in contact with the concrete. The insulating sheathing panel 186 and 187 are reinforced by means of a reinforcement layer 191. The reinforcement layer has adequate properties to receive the waterproof membrane of asphaltic emulsion.

Referring now to FIGS. 19, 19A, 19B and 19C. The fasteners 192 are movable. This permits the assembling of the modules from the exterior of the panel, thus following the normal surface direction of the formwork. Once the insulating sheathing panels 193 and 194 are in place, the fastener 192 is placed in the retaining devices 195 (which are preassembled at the factory site) located on the bearing devices 196 and 197. The retaining devices 195 can be opened and closed over the fastener 192 with a slight force. In the event that an adjustment is made, certain of the retaining devices 195 on the bearing device 196 are no longer usable and they must be replaced by fasteners 198 installed at the building site by use of a hammer. For further precaution, more fasteners 181 (shown in FIG. 17C) can be used to reinforce the joint. The bearing device 197 is connected to a similar bearing device on the other sheathing panel by means of a collapsible connecting element 199. The collapsible property of the connecting element 199 is made possible by using a flexible cable 200. The bearing device 196 is connected to a bearing device on the opposite sheathing panel by foldable connecting members 201. These connecting members 201 comprise rigid sections and hinges 202 to ensure the collapsible characteristic of the connecting element.

The insulating sheathing panels 193 and 194 are provided with a reinforcement layer 203. The waterproof membrane is an asphaltic emulsion 204 and is applied at the factory site on all the surfaces that are exposed and not in contact with the concrete.

With reference to FIGS. 20, 20A, 20B and 20C, the joint devices 205 and 206 are aligned with the ends of the sheathing panels 207 and 208. The device 209 is pivotable about the device 210 by removing the pin 211 from the two retaining devices 212. These two possibilities permit the assembling of the modules from the exterior and from the interior of the modules by following the normal direction of the surfaces of formwork. The assembling of the sheathing panels following the parallel direction of the formwork surfaces is always maintained since the device 209 opens and closes the device 213 under slight force. Adjustment along the joint is unlimited since the retaining piece 213 is in the direction of the length of the joint.

After the assembling and adjustment of the panels of the module is completed, fasteners 214, shown in FIG. 20C, are added by means of a hammer in order to prevent movement in any direction.

The bearing device 205 is connected with a similar bearing device on an opposite sheathing panel by means of a collapsible connecting element 215. This connecting element 215 is composed by a chain section 216 and a rigid link section 217. The bearing device 206 is connected to a similar bearing device on the other sheathing panel by means of collapsible connecting elements 218. The connecting elements 218 comprise flexible cable portions 219 and rigid links 220. The insulating sheathing panels 207 and 208 are reinforced on the exterior surfaces as well as on the interior surfaces by means of layers of reinforcement material 221. The waterproofing membrane is provided in sheets 222 which are installed on the panel at the factory site. The thermal bridge of the connecting element is broken by means of the layer of insulating material 223.

Figure 21A:
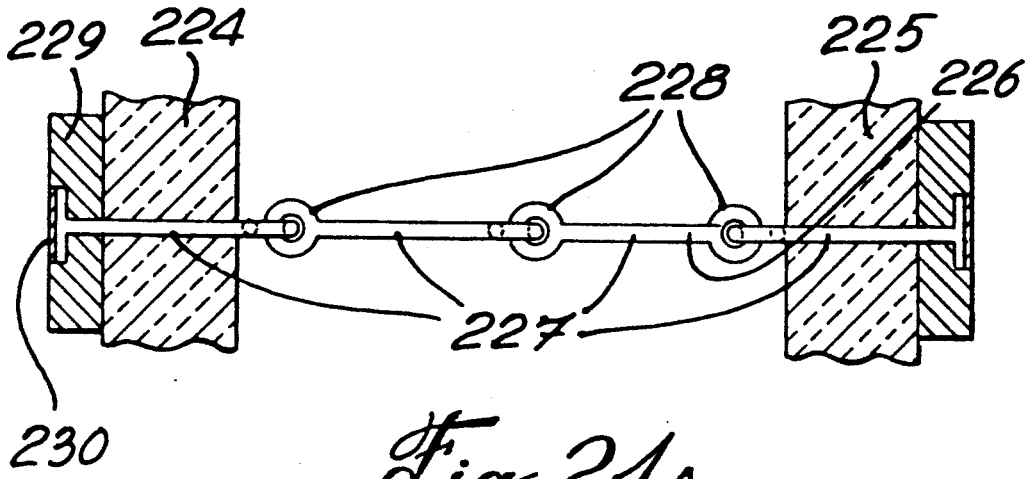
FIG. 21A is an enlarged fragmentary cross-sectional view taken at right angles to the view in FIG. 21.
Figure 21:
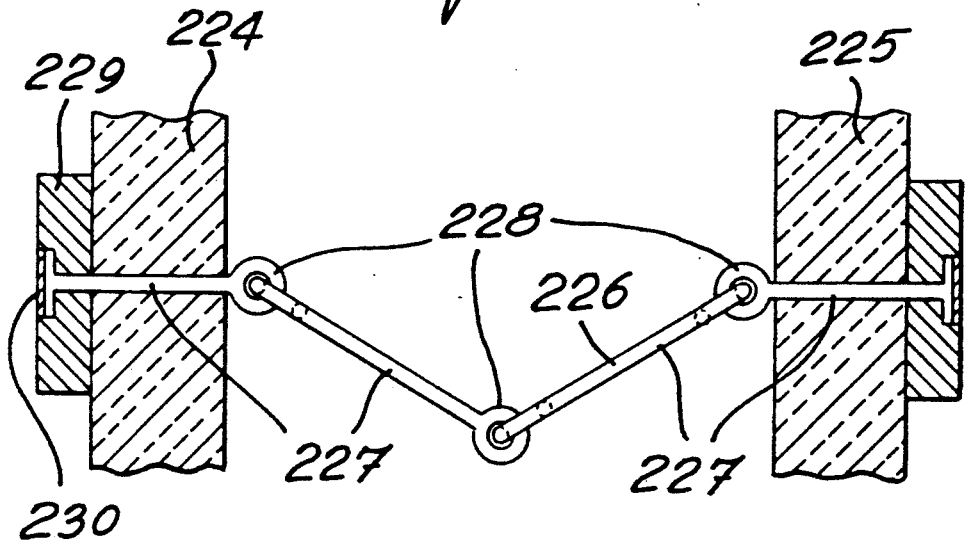
FIG. 21 is a fragmentary cross-sectional view taken through a typical form of the present invention showing an embodiment of the connecting element.

Referring now to FIGS. 21 and 21A, the insulating sheathing panel 224 is connected to the insulating sheathing panel 225 by a collapsible connecting element 226. The connecting element 226 comprises two rigid links 227 articulated by means of three hinge means 228. The collapsible characteristic of the connecting element 226 is obtained by means of the three hinges 228.

The configuration of the hinges 228 is in the form of two eyelets as shown. The connecting element 226 is fabricated from a cylindrical metal rod as shown or can be made from plastic or other material having a different shape. The insulating sheathing panel 224 is held by the bearing blocks 229. The thermal bridge of the connecting element 226, if metallic, is broken by means of a layer of insulation material 230 which forms the thermal break.

Figure 22A:
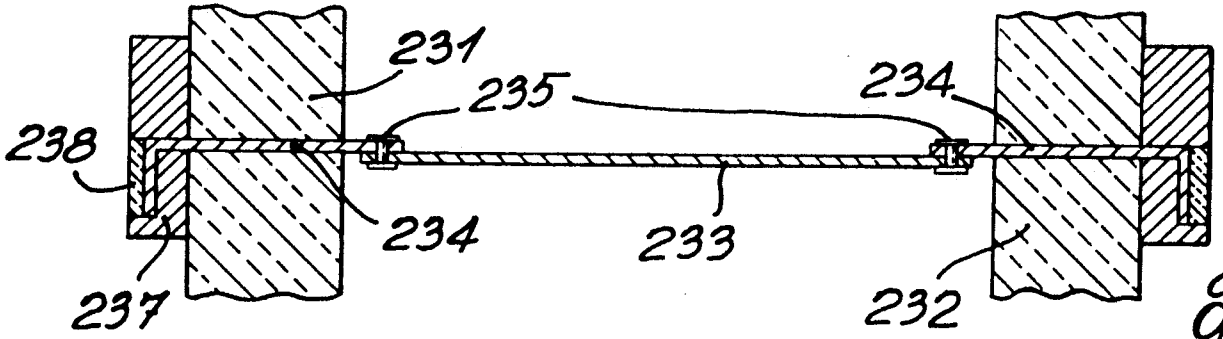
FIG. 22A is a cross-sectional view taken along lines N—N of FIG. 22.
Figure 22:
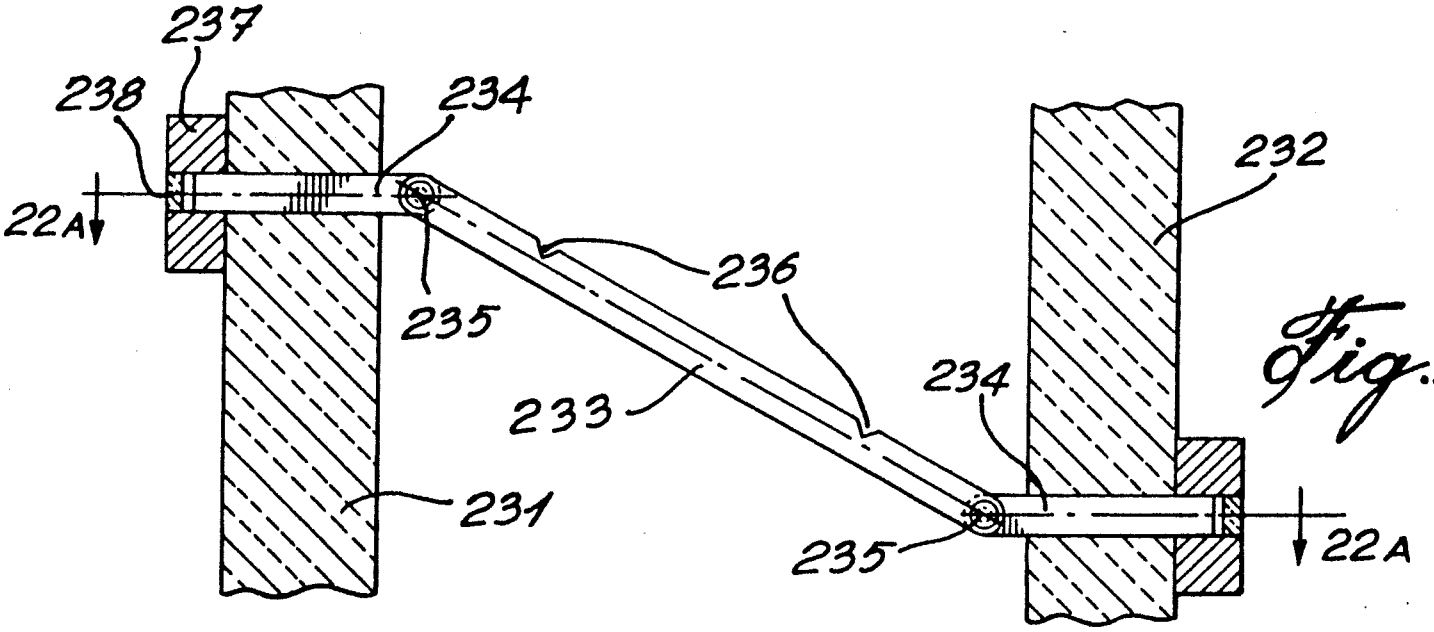
FIG. 22 is a cross-sectional view similar to FIG. 21 showing another embodiment of the connecting element of the present invention.

Referring now to FIGS. 22 and 22A, the insulating sheathing panel 231 is connected to the insulating sheathing panel 232 by means of a collapsible connecting element 233. The connecting element 233 comprises rigid link parts 234 articulated by means of hinge means 235. Configuration of the hinges 235 can include a shaft which is common to the two rigid parts which turn about the common shaft as shown. The connecting element 233 can be fabricated from a metal plate such as shown. The connecting element 233 includes notches 236 to support the rods of the concrete reinforcement grid. The insulating sheathing panel 231 is supported by the bearing block 237. The thermal break is provided by means of an insulating layer 238 preventing a thermal bridge to the metal connecting element 233.

Figure 23:
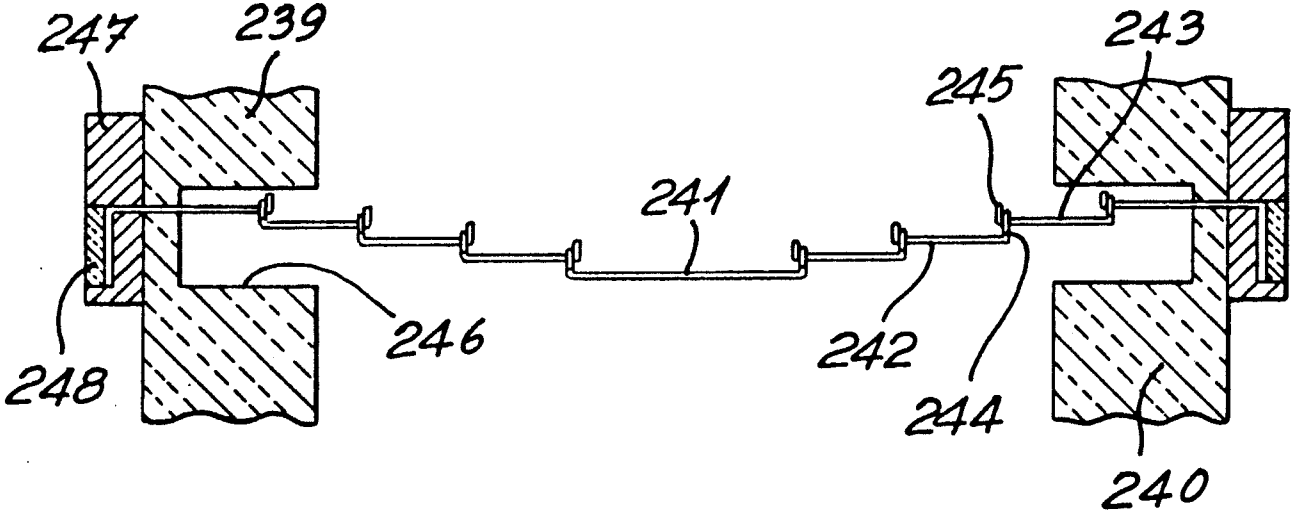
FIG. 23 is a fragmentary cross-sectional view similar to FIG. 21 showing still a further embodiment of a connecting element in accordance with the present invention.
Figure 23B:
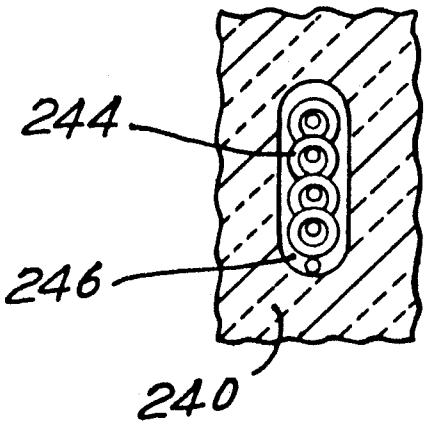
FIG. 23B is a fragmentary enlarged cross-sectional view taken along lines O—O of FIG. 23A.
Figure 23A:
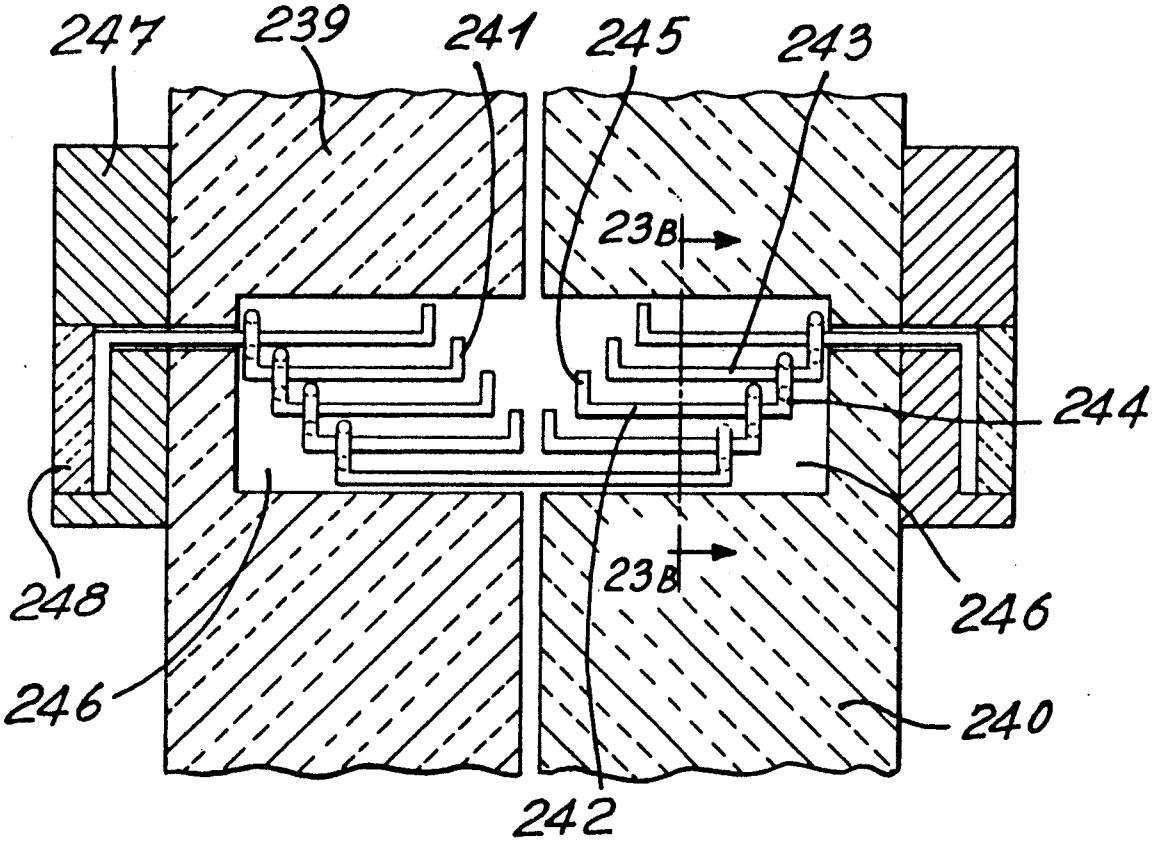
FIG. 23A is a cross-sectional view similar to FIG. 23 showing the form in a different operative position.

Referring now to FIGS. 23, 23A and 23B, the insulating sheathing panel 239 is connected to a similar insulating sheathing panel 240 by means of a collapsible connecting element 241 which is somewhat telescopic. The collapsible connecting element 241 comprises a number of rigid elements of which one element can slide relative to the other. For example element 242 slides on element 243 by means of an eyelet 244 on the link 242. The course of movement is limited by the stop 245. The telescopic mechanism can be obtained by sliding one rigid element with respect to another as shown or it can be a mechanism which permits extension and contraction movement between the elements. The collapsible connecting element 241 can be fabricated from a cylindrical metal rod such as shown. In its collapsed position the connecting element 241, in its telescopic mode as shown in FIG. 23A, is contained within cavities 246. These cavities permit the formwork to be collapsed and occupy the minimum of volume during storage and transportation. Insulating sheathing panel 239 is retained by bearing blocks 247. A thermal break is provided by a layer of insulating material 248 provided over the end of the connecting element 241, thereby preventing a thermal bridge.

Figures 24, 24A:
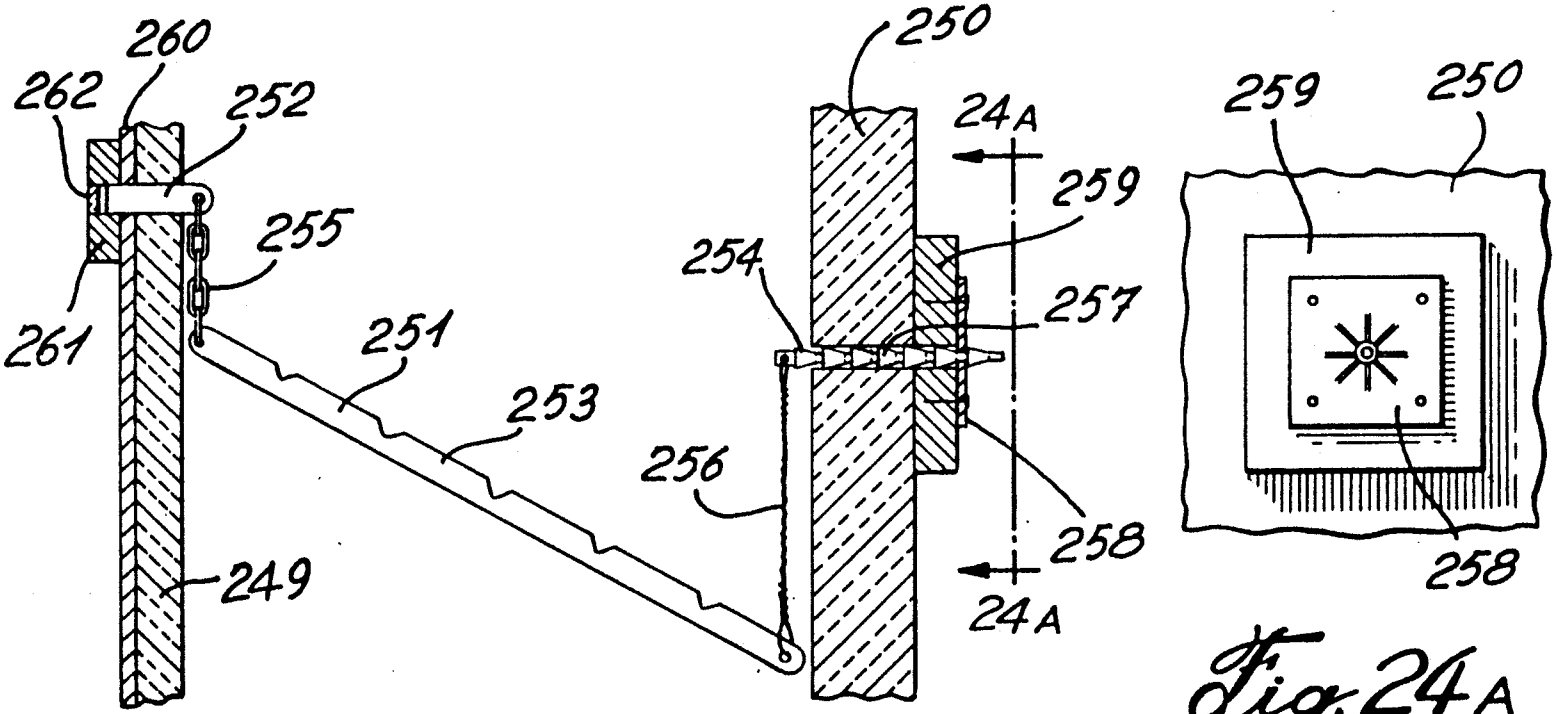
FIG. 24 is a fragmentary cross-sectional view similar to FIG. 21 showing a further embodiment of the connecting element of the present invention.
FIG. 24A is a fragmentary elevational view taken along lines P—P of FIG. 24.

Referring now to FIGS. 24 and 24A, the insulating sheathing panel 249 is connected to the insulating sheathing panel 250 by means of a collapsible connecting element having an adjustable length. The connecting element 251 is comprised of three rigid sections, namely section 252, section 253 and section 254, as well as to flexible sections, namely section 255 and section 256. The collapsible property of the connecting element 251 is provided by means of the two flexible sections, namely section 255 which is in the form of a chain and section 256 which is a cable. The configuration of the flexible sections can be a chain or a cable as shown. The length of the connecting element 251 is adjustable by means of an element 254 coupled to a retaining bracket 258. If it is required to have a connecting element of fixed length, that is non adjustable, sections 254 and 258 can be replaced by a section similar to section 252 during the fabrication thereof.

Section 254 has several notches 257 which permit its coupling with the retaining bracket 258. The bracket 258 includes an opening having weakening slits. Thus, the opening will be enlarged only in the direction of forward movement of the section 254, that is from the concrete side to the bracket side by means of deforming the material forming the bracket surrounding the slits. In order to reduce the thickness of the required concrete wall, it is necessary to reduce the length of the connecting element by means of pulling on the section 254 in the forward direction. The retaining bracket 258 is fixed to the bearing block 259 which will supply the support for the insulating panel 250. The insulating sheathing panels 249 and 250 are of the same insulating material. However, the insulating panel 249 as shown is thinner than panel 250 as it is reinforced by a reinforcement layer 260 made up of a panel of chip board. The bearing block 261 is shown smaller than the bearing block 259 since the reinforcement layer 260 has a better resistance to compression than the insulating panel 250. A thermal break is provided for the connecting element 251 by means of an insulating layer 262.

Figure 25A:
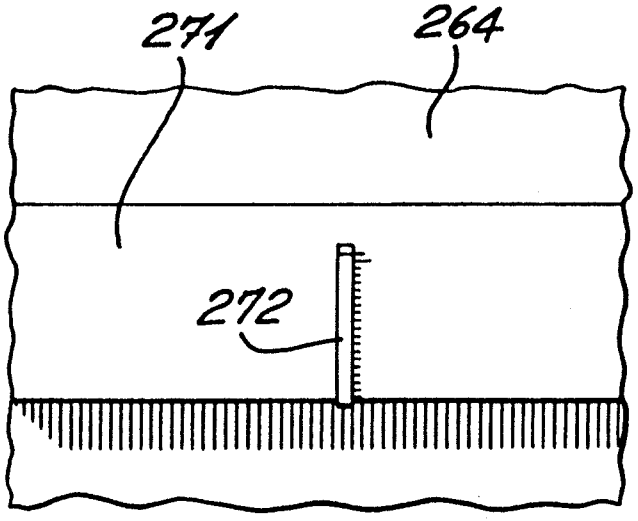
FIG. 25A is a fragmentary elevational view taken along lines Q—Q of FIG. 25.
Figure 25:
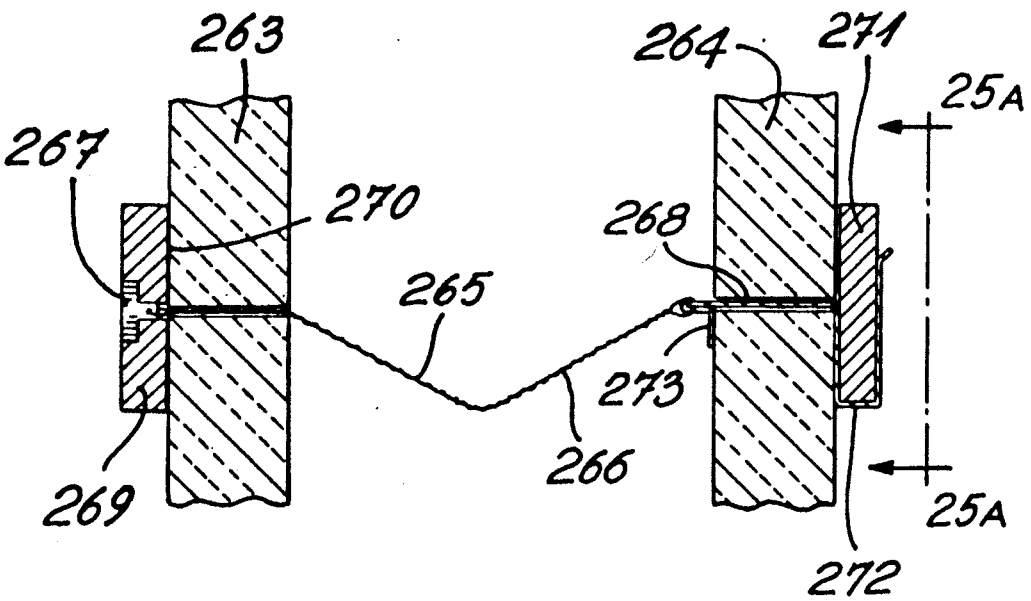
FIG. 25 is a fragmentary cross-sectional view similar to FIG. 21 showing still a further embodiment of the connecting element of the present invention.

Referring now to the embodiment shown in FIGS. 25 and 25A, the insulating sheathing panel 263 and the insulating sheathing panel 264 are both connected together by means of a collapsible connecting element 265. The connecting element 265 comprises a foldable section 266 made of a metal cable attached to a plug device 267 made of insulating rigid plastic and a metal device 268. The foldable section 266 is preferably a metal cable as shown. The insulating sheathing panel 263 is supported by a lost bearing device 269. The bearing device 269 can be fixed to the sheathing panel 263 by means of an adhesive coating 270 as shown or by other mechanical fasteners. The plug 267 is fixed to the bearing block 269. The insulating sheathing panel 264 is retained by the temporary bearing strip 271. The bearing strip 271 is called temporary since it can be removed and recuperated after the concrete has been cured. This element 271 can be utilized in other similar construction projects. The temporary bearing strip 271 can be a piece of wood 19 mm×89 mm as shown or by other shape and material which is suitable.

The element 271 will remain in good condition since no other work will be applied to this part. This is possible because the bearing strip 271 is maintained in place by the simple squeezing pressure exerted by the socket 268. The element 268 includes a jaw 272 which can be subjected to elastic deformation within a suitable limit. During the fabrication at the factory site, the jaw 272 is opened under pressure to introduce the bearing strip 271. After the pressure has been released the jaw 272 tightens against the block 271.

The element 268 is retained in place by means of a bracket 273 and the configuration of the jaw 272. After the concrete has hardened the block 271 is removed from the jaw 272 by means of a hammer and can be reused. The use of the connecting element with the possibility of removing the bearing block will be very useful in many types of applications, especially where the concrete surface of the wall is to be decorative and including brick construction etc.

Figure 26:
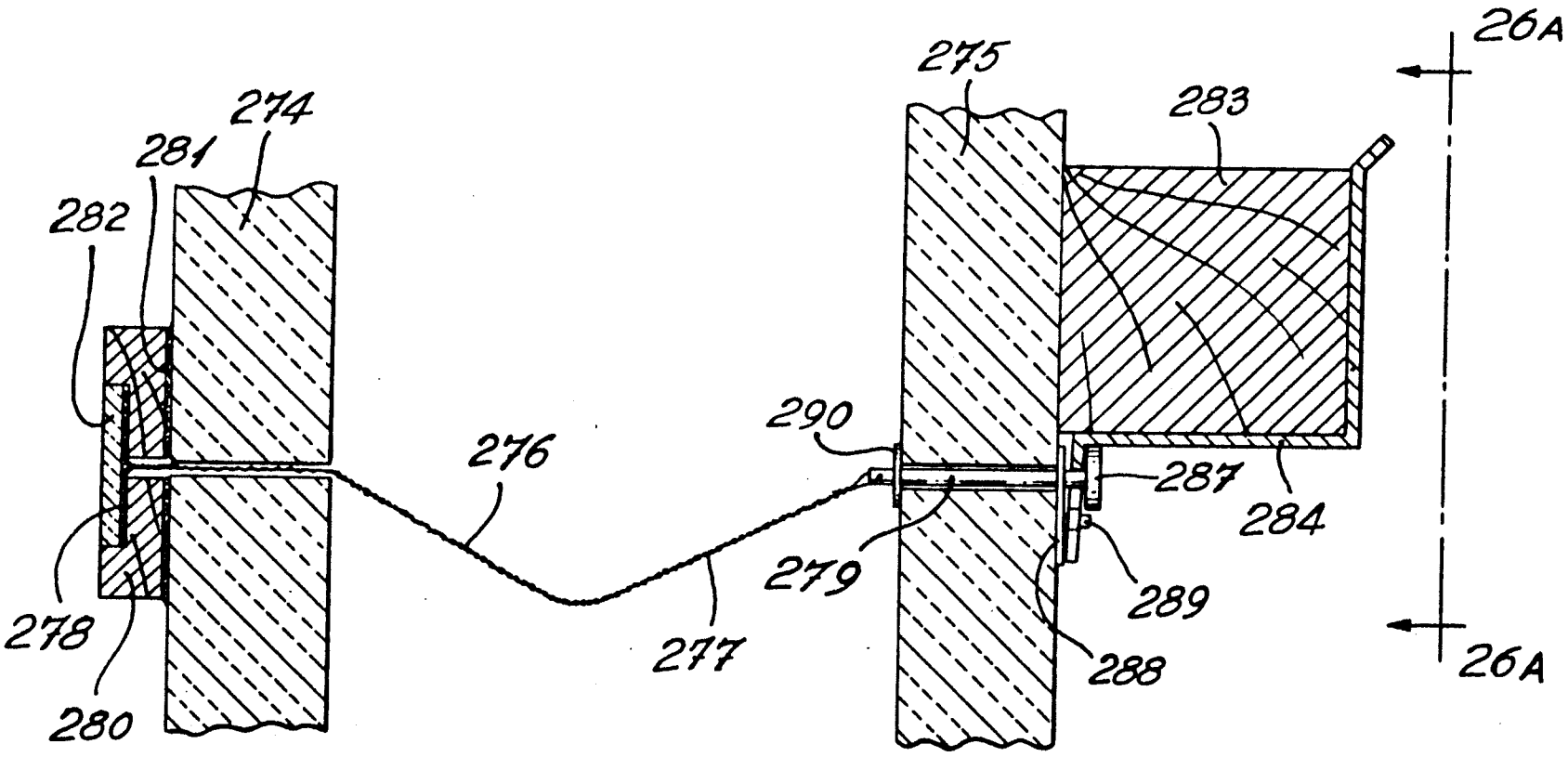
FIG. 26 is a fragmentary enlarged cross-sectional view similar to FIG. 21 but showing a still further embodiment of the connecting element of the present invention.
Figure 26A:
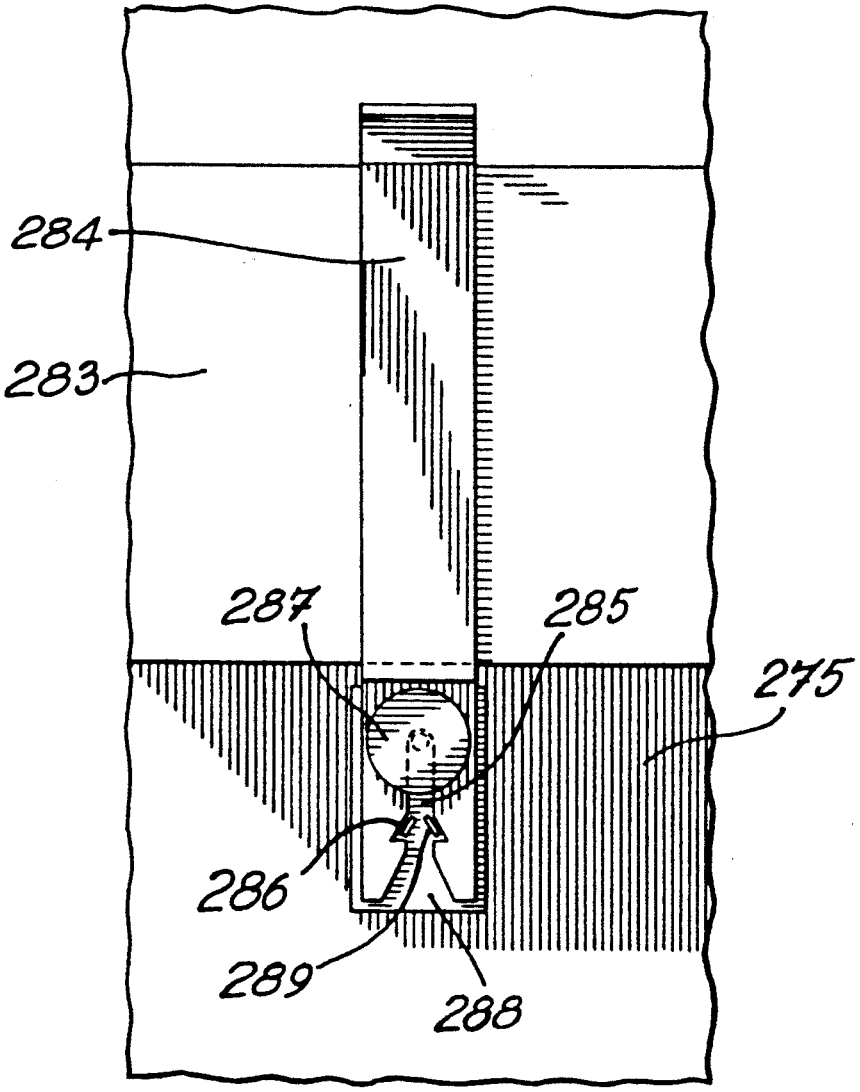
FIG. 26A is a fragmentary enlarged elevational view taken along lines R—R of FIG. 26.

Referring now to FIGS. 26 and 26A, the insulating sheathing panel 274 and insulating sheathing panel 275 are retained together by means of a collapsible connecting element 276. The connecting element 276 comprises a foldable section 277 which is connected to rod 278 and element 279. The foldable element 277 has the same configuration and characteristics as foldable element 266 in FIG. 25. The insulating sheathing panel 274 is supported by a lost bearing block 280 which is glued to the panel 274 by an adhesive coating 281. The collapsible connecting element 277 can be connected to element 278 by means of welding as shown or by other means. The thermal break for the metal connecting element 276 is provided by means of an insulating layer 282. The element 278 can be a metal rod.

Insulating sheathing panel 275 is retained by means of temporary bearing strip 283. The temporary bearing strip 283 can have the same shape and configuration as element 271 shown in FIGS. 25 and 25A. If desired, temporary structural elements to erect the formwork, that is to align and rearrange the formwork before and during the pouring of the concrete, can be used as element 283. The element 283 can be a 89 mm×89 mm piece of wood having any useful length. Element 283 is installed at the building site by means of a hammer. In effect, the element 283 is introduced under pressure into the opening formed by the sheathing panel 275 and the retaining member 284. The retaining member 284 is recuperable after the concrete has been cured.

The element 284 is provided with slot 285 and notches 286. During the erection of the formwork at the building site, element 284 is slipped into the space between the elements 287 and 288 of the device 279. During the fitting thereof the groove 285 is enlarged elastically on contact with the element 289 of element 279. The element 284 is blocked in its final position by means of the coupling of the notches 286 and the blocking element 289. The bracket element 279 is retained in place by means of collars 290 and 288.

Figure 27A:
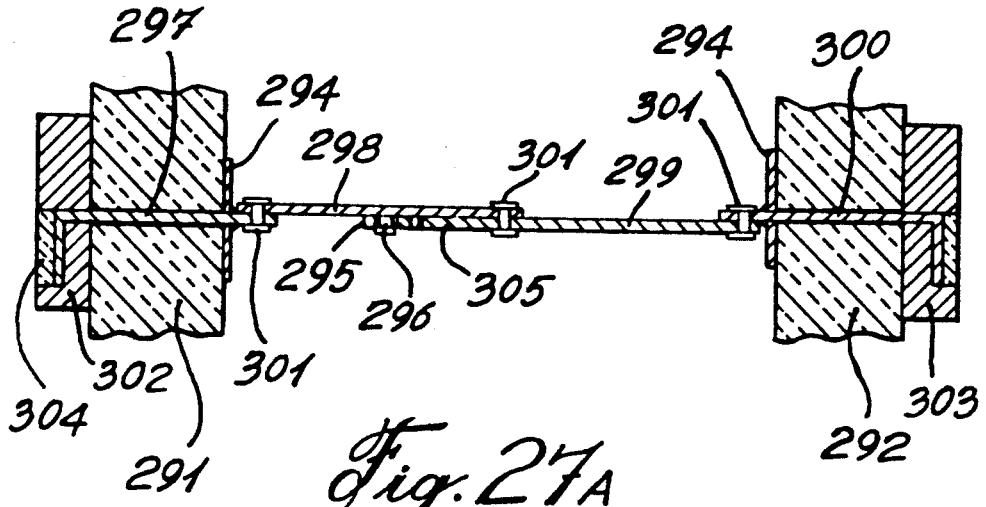
FIG. 27A is a cross-sectional view taken along lines S—S of FIG. 27.
Figure 27:
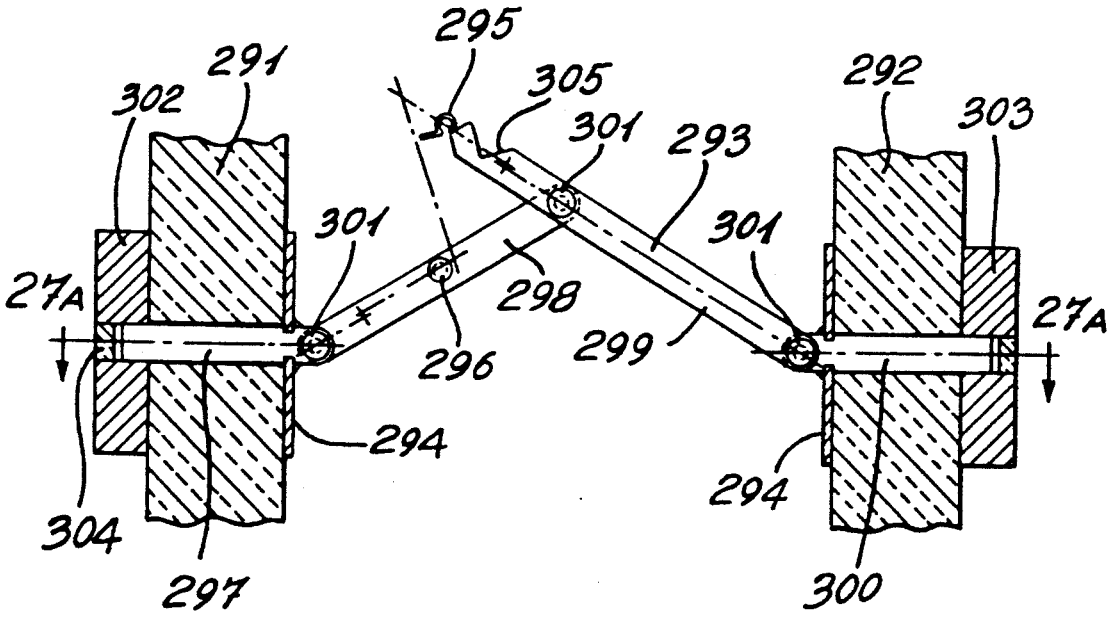
FIG. 27 is a fragmentary cross-sectional view similar to FIG. 21 showing a still further embodiment of the connecting element of the present invention.

Referring now to FIGS. 27 and 27A, insulating sheathing panel 291 and insulating sheathing panel 292 are maintained in spaced apart position by means of a link-spacer 293 which is assembled at the factory site. The link spacer 293 is an articulated connecting element which is provided with retaining means 294 and a blocking mechanism which includes a female element 295 and a male blocking element 296. The link-spacer 293 includes all the usual articulated link elements such as rigid sections 297, 298, 299, 300 and hinges 301. The sheathing panel 291 is retained by bearing block 302. The panel 292 is retained by the bearing block 303. The thermal break of the metalic parts is provided by means of insulating layers 304.

The connecting element function can be removed and the spacer function of the piece 293 retained by eliminating elements 297 and 300 and the bearing blocks 302 and 303. The spacer can have the retaining element 294 which exert a pressure on the insulating panel during the deployment at the building site as shown. The connecting function can be provided by an anchor mechanism or by chemical adhesive or a combination of the two. The blocking mechanism of the spacer can be provided by a female blocking element 295 fixed on a rigid element and the blocking male element 296 fixed on another element as shown. Any other anti-rotation devices can also be used.

To facilitate the deployment of the spacer with a rod, section 299 is provided with a notch 305. The section 293 of the spacer can be fabricated from a metal plate as shown.

We claim

1. In a formwork for molding a substantially vertical wall of a hardenable material, a prefabricated formwork module comprising a first sheathing panel, a second sheathing panel and a plurality of collapsible connecting elements retaining the first and second sheathing panels and extending at least partially therebetween in a spaced-apart relationship, the first and second sheathing panels having similar outlines with corresponding edges wherein each said collapsible element has at least a portion thereof, between the sheathing panels, which is deformable such that they allow the first ad second sheathing panels to collapse against and with the corresponding edges in relative alignment with each other, the formwork and connecting elements being constructed and assembled at a factory site remote from the building site such that during storage and transportation of the formwork modules each formwork module is collapsed with the first and second sheathing panels adjacent one another and with the corresponding edges in relative alignment with each other with the connecting elements collapsed and wherein the first and second sheathing panels are spaced apart to the full extent of the connecting elements during assembly at the building site.

2. A prefabricated formwork module as defined in claim 1 wherein at least one of the sheathing panels is made of insulating material.

3. A formwork module as defined in claim 1 wherein a vapor barrier is preassembled to one of the sheathing panels at the factory site.

4. A formwork module as defined in claim 1 wherein filler strips are mounted to the sheathing panels on the exterior surface thereof at the factory site.

5. A prefabricated formwork module as defined in claim 4 wherein the filler strips are continuous wooden strips which also act as bearing blocks for the connecting elements and the filler strips are mounted to the exterior surface of one of the sheathing panels at the factory site.

6. A prefabricated formwork module as defined in claim 4 wherein the filler strips are in the form of an elongated plastic element and extend along the exterior surfaces of one of the sheathing panels and can act as bearing blocks for the connecting elements.

7. A prefabricated formwork module as defined in claim 4 wherein the filler strip is a metallic stamping or extrusion mounted at the factory site on the exterior of one of the sheathing panels and can act as a bearing block for the connecting elements.

8. A prefabricated formwork module as defined in claim 1 wherein a reinforcement is provided between the sheathing panels at the factory site and is collapsible for storage and transportation with the sheathing panels, the reinforcement being sandwiched therebetween.

9. A prefabricated formwork module as defined in claim 1 wherein at least one of the sheathing panels is made of insulating material; a vapor barrier, waterproof membrane, filler strips are mounted on at least one of the sheathing panels at the factory site while a reinforcement is located between the sheathing panels during the assembly at the factory site and is collapsible therewith as being sandwiched between the sheathing panels.

10. A prefabricated formwork module as defined in claim 1 wherein the connecting elements pass through the sheathing panels and abut each end against bearing blocks located on the exterior face of at least one of the sheathing panels.

11. A prefabricated formwork module as defined in claim 10 wherein the bearing blocks are provided with the sheathing panels at the factory site and the collapsible connecting elements are associated with the bearing blocks at the factory site.

12. A prefabricated formwork module as defined in claim 10 wherein the bearing blocks are in the form of a panel overlying the exterior surface of at least one sheathing panel.

13. A prefabricated formwork module as defined in claim 12 wherein the panel overlying the exterior surface is in the form of a perforated plate or open grid.

14. A prefabricated formwork module as defined n claim 10 wherein at least one of the bearing blocks is in the form of a reusable strip applied at the building site and the end of the connecting element includes a retaining device for receiving the strip in order to connect the connecting element thereto.

15. A prefabricated formwork module as defined in claim 1 wherein the connecting element is a multistrand flexible metal cable.

16. A prefabricated formwork module as defined in claim 1 wherein the connecting elements include a bunch of mono-filament flexible strands individually spaced apart and individually abut the bearing blocks.

17. A prefabricated formwork module as defined in claim 1 wherein the connecting element is a flexible chain made up of chain links.

18. A prefabricated formwork module as defined n claim 1 wherein a spacer in the form of an elongated member extends between the first sheathing panel and the second sheathing panel at the building site when the formwork module is being erected.

19. A prefabricated formwork module as defined in claim 18 wherein the spacer is prefabricated independently of the formwork module and is inserted between the first sheathing panel and the second sheathing panel only when the panels have been separated apart while being erected at the building site.

20. A prefabricated formwork module as defined in claim 19 wherein the spacer is a rigid link member with baring means fixed to each end thereof having a length corresponding to the space between the first and second sheathing panels when they are separated to an erected position a the building site.

21. A prefabricated formwork module as defined in claim 19 wherein the spacer is a rigid member having at least one hinge allowing the spacer to be folded for insertion or removal from between the first and second panels.

22. A prefabricated formwork as defined in claim 1, wherein the corresponding edges of the first and second sheathing panels each have respective joint means for permitting the modules to be erected one to the other in edge-to-edge relationship to make up the formwork, and wherein the joints of contiguous panels are covered by covering elements extending along at least a portion of the respective edges.

23. In a formwork as defined in claim 1, wherein a plurality of modules make up the formwork when installed with corresponding first and second sheathing panels in respective common substantially vertical planes, corresponding edges of contiguous panels forming joints and said contiguous panels having joint elements overlapping the joints to prevent width-wise movement of one panel relative to another in a common plane but to allow limited longitudinal sliding movement within the common plane of one panel relative to a contiguous panel.

24. A prefabricated formwork module as defied in claim 1 wherein the sheathing panel includes an open grid on the exterior thereof and sheathing layers are provided on the interior thereof.

25. In a formwork as defied in claim 1, wherein a plurality of modules make up the formwork when installed with corresponding first and second sheathing panels in respective common substantially vertical planes, corresponding edges of each module having mating male and female joint means intercalated in order to prevent width-wise movement of one sheathing panel relative to another in the same plane.

26. In a formwork as defined in claim 25, wherein the male and female joint means allow limited longitudinal movement of the panels in the same plane in order to permit adjustments due to imperfections.

27. A prefabricated formwork module as defined in claims 22 or 23 wherein a deformable retaining means is provided to lock the joint in place once the modules have been assembled.

28. A formwork as defined in claim 1, wherein a water-proof membrane is provided on a portion of at least one of the sheathing panels of the formwork module at the factory site.

29. In a formwork for molding a substantially vertical wall of a hardenable material, a prefabricated formwork module comprising a first sheathing panel, a second sheathing panel and a plurality of collapsible connecting elements retaining the first and second sheathing panels and extending at least partially therebetween in a spaced-apart relationship, wherein the connecting elements pass through the sheathing panels and abut at each end against bearing blocks located on the exterior face of at least one of the sheathing panels, wherein the collapsible connecting element is in the form of at least three links in series connected end to end by two hinging means such as to allow the connecting element to fold when the formwork module is collapsed, the formwork module and connecting elements being constructed and assembled at a factory site remote from the building site such that during storage and transportation of the formwork modules, each formwork module is collapsed with the first and second sheathing panel adjacent one another with the connecting elements collapsed and wherein the first and second sheathing panels are spaced apart to the full extent of the connecting elements during assembly at the building site.

30. A prefabricated formwork module as defined in claim 29 wherein the connecting element comprises a series of links connected end to end by at least three hinges.

31. A prefabricated formwork as defined in claim 30 wherein the connecting element includes a first link member including a head portion associated with the baring block on the exterior of the first sheathing panel and the first link member extends through the width of the first sheathing panel, a first hinge means is in the form of an eyelet at the end of the first link member adjacent an inner surface of the first sheathing panel, a second link member extends through the second sheathing panel and includes a head associated with the bearing block on the exterior surface of the second sheathing panel and a second hinge means which includes an eyelet at the end of the second link member adjacent the inner surface of the second sheathing panel and a pair of link members is hinged at the first and second eyelets and include an eyelet intermediate the pair of link members extending between the first and second eyelets such that the pair of link members can fold against each other when the first and second sheathing panels are collapsed.

32. A prefabricated formwork module as defined in claim 29 wherein the connecting element includes a first link member including a head associated with a bearing block on the exterior surface of the first sheathing panel, a second link member extending through the second sheathing panel and including a head associated with a bearing block on the exterior of the second sheathing panel, and a third link member hinged to the end of the first link member at one end thereof and to the end of the second link member at the other end thereof whereby the connecting element will fold when the formwork module is collapsed.

33. In a formwork for molding a vertical wall of a hardenable material, a prefabricated formwork module comprising a first sheathing panel, a second sheathing panel and a plurality of collapsible connecting elements retaining the first and second sheathing panels and extending at least partially therebetween in a spaced-apart relationship, wherein the connecting elements pass through the sheathing panels and abut at each end against bearing blocks located on the exterior face of at least one of the sheathing panels, wherein the connecting element is a collapsible link member of adjustable length and at least one of the bearing blocks is provided with a one way deformable bracket adapted to engage stop means provided on the connecting element and thereby retain the connecting element at a desired length, the formwork module and connecting elements being constructed and assembled at a factory site remote from the building site such that during storage and transportation of the formwork modules, each formwork module is collapsed with the first and second sheathing panel adjacent one another with the connecting elements collapsed and wherein the first and second sheathing panels are spaced apart to the full extent of the connecting elements during assembly at the building site.

34. In a formwork for molding a substantially vertical wall of a hardenable material, a prefabricated formwork module comprising a first sheathing panel, a second sheathing panel and a plurality of collapsible connecting elements retaining the first and second sheathing panels and extending at least partially therebetween in a spaced-apart relationship, wherein the connecting elements pass through the sheathing panels and abut at each end against bearing blocks located on the exterior face of at least one of the sheathing panels, wherein the connecting element includes a first link member extending through a portion of the first sheathing panel and including a head associated with a bearing block on the exterior surface of the first sheathing panel, the first sheathing panel including a cavity to accommodate a portion of the first link member and a second rigid link member extending through a portion of the second sheathing panel and including a head associated with the bearing block on the exterior surface of the second sheathing panel and the second sheathing panel including a cavity accommodating a portion of the second link member and a plurality of telescoping link members extending between the first and second link members of the connecting element whereby when the module is being collapsed, the telescopic link parts telescope within the cavities formed within the first and second sheathing panel, the formwork module and connecting elements being constructed and assembled at a factory site remote from the building site such that during storage and transportation of the formwork modules, each formwork module is collapsed with the first and second sheathing panel adjacent one another with the connecting elements collapsed and wherein the first and second sheathing panels are spaced apart to the full extent of the connecting elements during assembly at the building site.

35. A prefabricated formwork structure for molding a substantially vertical wall of a hardenable material, including a prefabricated formwork module comprising a first sheathing panel, a second sheathing panel and a plurality of collapsible connecting elements retaining the first and second sheathing panels and extending at least partially therebetween in a spaced-apart relationship, the formwork module and connecting elements being constructed and assembled at a factory site remote from the building site such that during storage and transportation of the formwork modules each formwork module is collapsed with the first and second sheathing panels adjacent one another with the connecting elements collapsed and wherein the first and second sheathing panels are spaced apart to the full extent of the connecting elements during assembly at the building site, a spacer in the form of an elongated member extending between the first sheathing panel and the second sheathing panel at the building site when the formwork module is being erected, wherein th spacer includes a plurality of collapsible rigid links between the first and second panels respectively and the spacer is preinstalled at the factory site.

* * * * *